US009629414B2

(12) United States Patent
Elder et al.

(10) Patent No.: US 9,629,414 B2
(45) Date of Patent: Apr. 25, 2017

(54) SOLE STRUCTURE FOR AN ARTICLE OF FOOTWEAR

(71) Applicant: NIKE, Inc., Beaverton, OR (US)

(72) Inventors: Zachary M. Elder, Portland, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 250 days.

(21) Appl. No.: 13/939,522

(22) Filed: Jul. 11, 2013

(65) Prior Publication Data

US 2015/0013185 A1 Jan. 15, 2015

(51) Int. Cl.

| | |
|---|---|
| ***A43B 13/00*** | (2006.01) |
| ***A43B 13/14*** | (2006.01) |
| ***A43B 13/12*** | (2006.01) |
| ***A43B 13/18*** | (2006.01) |
| ***A43B 13/28*** | (2006.01) |

(52) U.S. Cl.

CPC ..... *A43B 13/14* (2013.01); *A43B 13/122* (2013.01); *A43B 13/184* (2013.01); *A43B 13/28* (2013.01)

(58) Field of Classification Search

CPC ..... A43B 13/141; A43B 13/143; A43B 7/144; A43B 3/246; A43B 13/127; A43B 13/28; A43B 13/184; A43B 13/122

USPC ..... 36/28, 35 R, 83, 92, 103

See application file for complete search history.

(56) References Cited

U.S. PATENT DOCUMENTS

| | | | | |
|---|---|---|---|---|
| 5,185,943 | A * | 2/1993 | Tong | A43B 13/184 36/27 |
| 5,187,883 | A | 2/1993 | Penney | |
| 5,396,718 | A | 3/1995 | Schuler et al. | |
| 5,572,804 | A * | 11/1996 | Skaja et al. | 36/29 |
| 5,628,128 | A * | 5/1997 | Miller | A43B 7/1495 36/114 |
| 6,082,023 | A | 7/2000 | Dalton | |
| 6,438,870 | B2 * | 8/2002 | Nasako | A43B 13/181 36/103 |
| 6,823,612 | B2 | 11/2004 | Manz et al. | |
| 6,983,557 | B2 | 1/2006 | Manz et al. | |
| 7,020,988 | B1 | 4/2006 | Holden et al. | |
| 7,082,699 | B2 | 8/2006 | Nishiwaki et al. | |
| 7,162,815 | B2 * | 1/2007 | Miyauchi | A43B 13/181 36/103 |
| 7,254,907 | B2 | 8/2007 | Nishiwaki et al. | |
| 7,370,443 | B2 | 5/2008 | Gibert et al. | |
| 7,434,337 | B2 | 10/2008 | Gibert et al. | |

(Continued)

*Primary Examiner* — Anna Kinsaul
*Assistant Examiner* — Jillian K Pierorazio
(74) *Attorney, Agent, or Firm* — Banner & Witcoff, Ltd.

(57) ABSTRACT

A sole structure of an article of footwear has a support assembly structure including a flexure element and an upper support element. The flexure element may have a central portion located between first and second ground-contacting or lower regions, wherein the central portion may have a downwardly concavely-curved shell-like region. The flexure element also may have first and second flanges extending upward from the first and second lower regions, respectively. The upper support element is positioned above the central portion and between the first and second flanges of the flexure element. When a vertical compressive load is first applied to the upper support element, the upper support element moves vertically relative to the first and second flanges. An article of footwear having the sole structure attached to an upper is also provided.

36 Claims, 19 Drawing Sheets

(56) References Cited

U.S. PATENT DOCUMENTS

| | | | | |
|---|---|---|---|---|
| 7,464,489 | B2 * | 12/2008 | Ho | A43B 13/181 36/28 |
| 7,866,063 | B2 * | 1/2011 | Caine | A43B 13/026 36/114 |
| 7,946,059 | B2 * | 5/2011 | Borel | A43B 13/026 36/28 |
| 7,987,618 | B2 * | 8/2011 | Nishiwaki | A43B 13/181 36/25 R |
| 8,453,344 | B2 * | 6/2013 | Nishiwaki | A43B 13/10 36/103 |
| 2003/0051373 | A1 * | 3/2003 | Goodwin | A43B 13/12 36/29 |
| 2003/0140523 | A1 | 7/2003 | Issler | |
| 2003/0200678 | A1 | 10/2003 | Nishiwaki et al. | |
| 2004/0177530 | A1 | 9/2004 | Nishiwaki et al. | |
| 2005/0246922 | A1 | 11/2005 | Gibert et al. | |
| 2006/0201028 | A1 * | 9/2006 | Chan | A43B 7/142 36/28 |
| 2008/0155859 | A1 * | 7/2008 | Chandler | A43B 13/14 36/92 |
| 2009/0019729 | A1 * | 1/2009 | Nakano et al. | 36/91 |
| 2009/0113758 | A1 * | 5/2009 | Nishiwaki | A43B 13/10 36/88 |
| 2009/0139114 | A1 * | 6/2009 | Malek | A43B 7/144 36/3 B |
| 2010/0071228 | A1 * | 3/2010 | Crowley, II | A43B 13/181 36/28 |
| 2010/0281711 | A1 * | 11/2010 | Vestuti | A43B 1/0072 36/28 |
| 2011/0185590 | A1 * | 8/2011 | Nishiwaki | A43B 5/06 36/28 |
| 2012/0131819 | A1 * | 5/2012 | Loverin | A43B 1/10 36/35 R |

* cited by examiner

SOLE STRUCTURE FOR AN ARTICLE OF FOOTWEAR

FIELD

Aspects of the present invention relate to sole structures for articles of footwear and articles of footwear including such sole structures. More particularly, various examples relate to sole structures having improved vertical compression and transverse stiffness characteristics.

BACKGROUND

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

Despite the differences between the various footwear styles, sole structures for conventional footwear generally include multiple layers that are referred to as an insole, a midsole, and an outsole. The insole is a thin, cushioning member located adjacent to the foot that enhances footwear comfort. The outsole forms the ground-contacting element of footwear and is usually fashioned from a durable, wear resistant material that may include texturing or other features to improve traction.

The midsole forms the middle layer of the sole and serves a variety of purposes that include controlling potentially harmful foot motions, such as over pronation; shielding the foot from excessive ground reaction forces; and beneficially utilizing such ground reaction forces for more efficient toe-off. Conventional midsoles may include a foam material to attenuate impact forces and absorb energy when the footwear contacts the ground during athletic activities. Other midsoles may utilize fluid-filled bladders (e.g., filled with air or other gasses) to attenuate impact forces and absorb energy.

Although foam materials in the midsole succeed in attenuating impact forces for the foot, foam materials that are relatively soft may also impart instability that increases in proportion to midsole thickness. For example, the use of very soft materials in the midsole of running shoes, while providing protection against vertical impact forces, can encourage instability of the ankle, thereby contributing to the tendency for over-pronation. This instability has been cited as a contributor to "runner's knee" and other athletic injuries. For this reason, footwear design often involves a balance or tradeoff between impact force attenuation and stability.

Stabilization is also a factor in sports like basketball, volleyball, football, and soccer. In addition to running, an athlete may be required to perform a variety of motions including transverse movement; quickly executed direction changes, stops, and starts; movement in a backward direction; and jumping. While making such movements, footwear instability may lead to excessive inversion or eversion of the ankle joint, potentially causing an ankle sprain.

High-action sports, such as soccer, basketball, football, rugby, ultimate, etc., impose special demands upon players and their footwear. Accordingly, it would be desirable to provide footwear that achieves better dynamic control of the wearer's movements, while at the same time providing impact-attenuating features that protect the wearer from excessive impact loads.

BRIEF SUMMARY

According to aspects of the invention, a sole structure of an article of footwear has a support assembly structure including a flexure element and an upper support element. The flexure element has a central portion located between first and second ground-contacting regions, wherein the central portion has a downwardly concavely-curved plate-like region. The flexure element also has first and second flanges extending upward from the first and second ground-contacting regions, respectively. The upper support element is positioned above the central portion and between the flanges of the flexure element. When a vertical compressive load is first applied to the upper support element, the upper support element moves vertically relative to the flanges.

According to other aspects, the upper support element may compress the downwardly concavely-curved plate-like region when a vertical compressive load is applied. During the application of the compressive load, the flanges may slidably interface with the upper support element, and the ground-contacting surfaces may move transversely relative to the downwardly concavely-curved plate-like region.

According to certain aspects, a plurality of legs may extend across the ground-contacting regions and further, may extend up into the flanges. The cutouts that define the legs may be transversely visible from the outside of the footwear.

The flexure element may have a recurved cross section, in which case an upwardly concavely-curved region will be located between the downwardly concavely-curved plate-like central region and one of the ground-contacting regions. Further, the flexure element may have a doubly-recurved cross-section, in which case an upwardly concavely-curved region will be located between the downwardly concavely-curved plate-like central region and each of the ground-contacting regions.

One or more gussets may be provided between the central portion and the flanges to stiffen the flexure element, in particular, to stiffen the flanges.

The support assembly structure may be located in a heel region and/or in a forefoot region of the sole structure.

According to another aspect of the invention, a support assembly structure includes a flexure element extending from a lateral-side ground-contacting region to a medial-side ground-contacting region. The flexure element includes a substantially planar central portion that is provided with a doubly-recurved cross-section. The flexure element also has flanges extending upward from the ground-contacting regions. The flanges may have legs and cutouts.

An article of footwear including an upper attached to the sole structure disclosed herein is also described herein.

BRIEF DESCRIPTION OF THE DRAWINGS

The foregoing Summary, as well as the following Detailed Description, will be better understood when read in conjunction with the accompanying drawings.

Figure 1A:
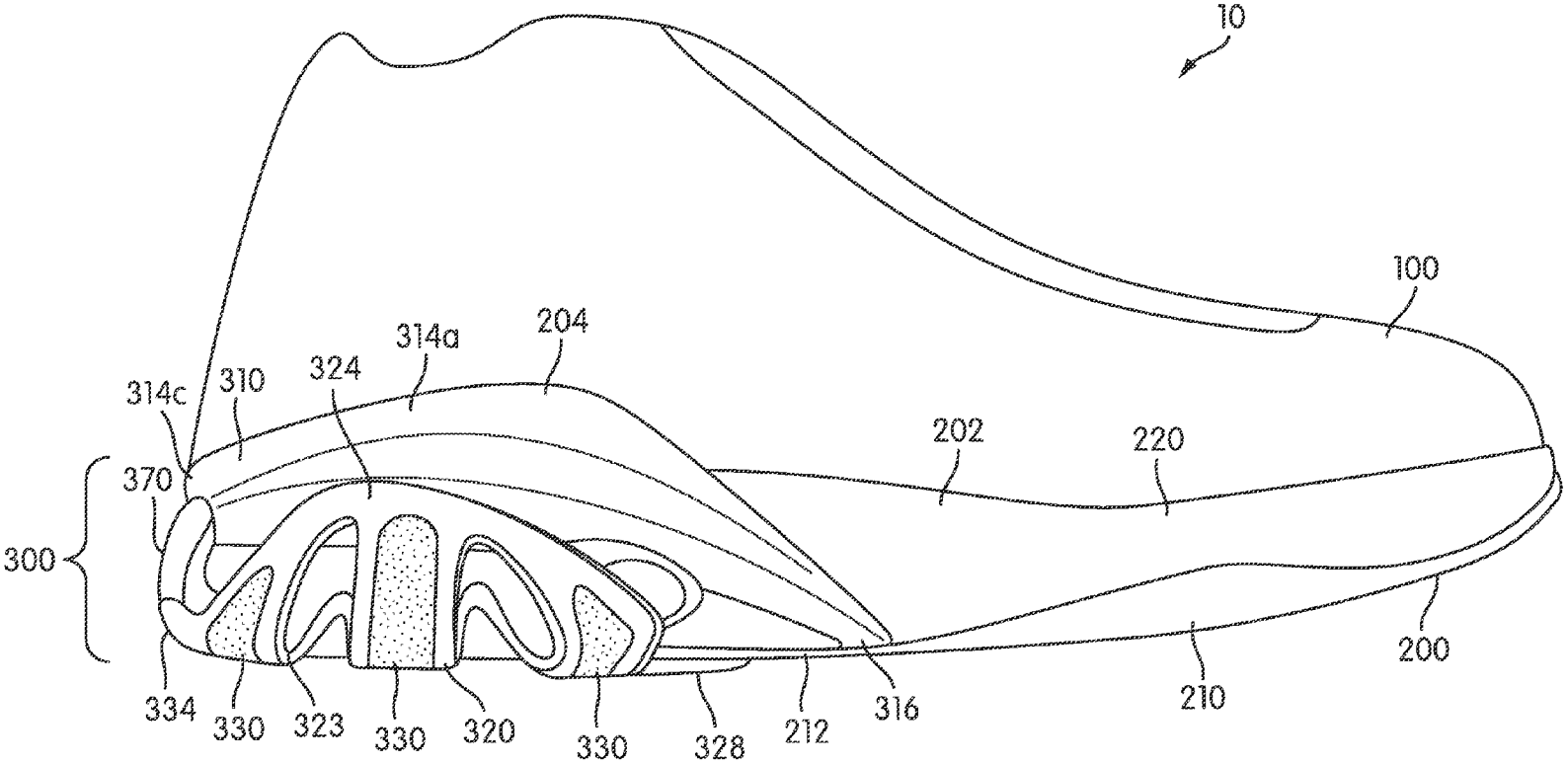
FIG. 1A is a side view, looking from the lateral side, of an article of footwear having an upper and a sole structure in accordance with aspects of this disclosure.

It should be understood that the appended drawings are not necessarily to scale, presenting a somewhat simplified representation of various features illustrative of specific aspects of the invention. Certain features of the illustrated embodiments may have been enlarged or distorted relative to others to facilitate visualization and clear understanding. In particular, thin features may be thickened, for example, for clarity of illustration.

DETAILED DESCRIPTION

The following discussion and accompanying figures disclose articles of footwear having sole structures with sole geometries in accordance with various embodiments of the present disclosure. Concepts related to the sole geometry are disclosed with reference to a sole structure for an article of athletic footwear. The disclosed sole structure may be incorporated into a wide range of athletic footwear styles, including shoes that are suitable for rock climbing, bouldering, hiking, running, baseball, basketball, cross-training, football, rugby, tennis, volleyball, and walking, for example. In addition, sole structures according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the sole structure apply to a wide variety of footwear styles, in addition to the specific styles discussed in the following material and depicted in the accompanying figures.

Sports generally involve consistent pounding of the foot and/or periodic high vertical impact loads on the foot. Thus, a sole structure for an article of footwear having an impact-attenuation system capable of handling high impact loads may be desired. Additionally, however, many sports involve transverse movements that are separate from the movements that involve large vertical impact loads. It may be desirable to have a relatively soft transverse stiffness characteristic (for example, to aid in cutting), while at the same time having a robust vertical impact-attenuation characteristic. Optionally, it may be desirable to have a relatively unforgiving transverse stiffness characteristic (for example, to provide greater stability), while at the same time having a relatively compliant vertical impact-attenuation characteristic. Thus, it may be advantageous to have a sole structure that decouples the vertical stiffness characteristic from the transverse stiffness characteristic. Such a decoupled sole structure would provide a vertical stiffness response that is independent of (or relatively independent of) the transverse stiffness response. It may be advantageous to have such a decoupled sole structure located in the forefoot region of the footwear. It may be particularly advantageous to have such a decoupled sole structure located in the heel region of the footwear.

As noted above, according to certain aspects, it may be advantageous to have a sole structure that decouples the vertical stiffness characteristic from a side-to-side transverse stiffness characteristic. For certain specific applications, it may even be advantageous to have a sole structure that decouples the vertical stiffness characteristic from a front-to-back transverse stiffness characteristic.

Various aspects of this disclosure relate to articles of footwear having a sole structure with a support structure assembly designed to decouple its vertical stiffness characteristics from its transverse stiffness characteristics. Thus, according to certain embodiments, it would be desirable to tailor footwear to provide an optimum amount of protection against vertical impact loads, yet at the same time provide an optimum level of transverse flexibility/stability.

As used herein, the terms "upper," "lower," "top," "bottom," "upward," "downward," "vertical," "horizontal," "longitudinal," "transverse," "front," "back," "forward," "rearward," etc., unless otherwise defined or made clear from the disclosure, are relative terms meant to place the various structures or orientations of the structures of the article of footwear in the context of an article of footwear worn by a user standing on a flat, horizontal surface. "Transverse" refers to a generally sideways (i.e., medial-to-lateral or heel-to-toe) orientation (as opposed to a generally vertical orientation). "Lateral" refers to a generally medial-to-lateral (i.e., side-to-side) transverse orientation. "Longitudinal" refers to a generally heel-to-toe (i.e., front-to-back) transverse orientation. A "lateral roll" is characterized by upward and/or downward displacement of a medial side of a foot portion relative to a lateral side of the foot portion. A "longitudinal roll" is characterized by upward and/or downward displacement of a forward end of a foot portion relative to a rearward end of the foot portion.

Figure 1B:
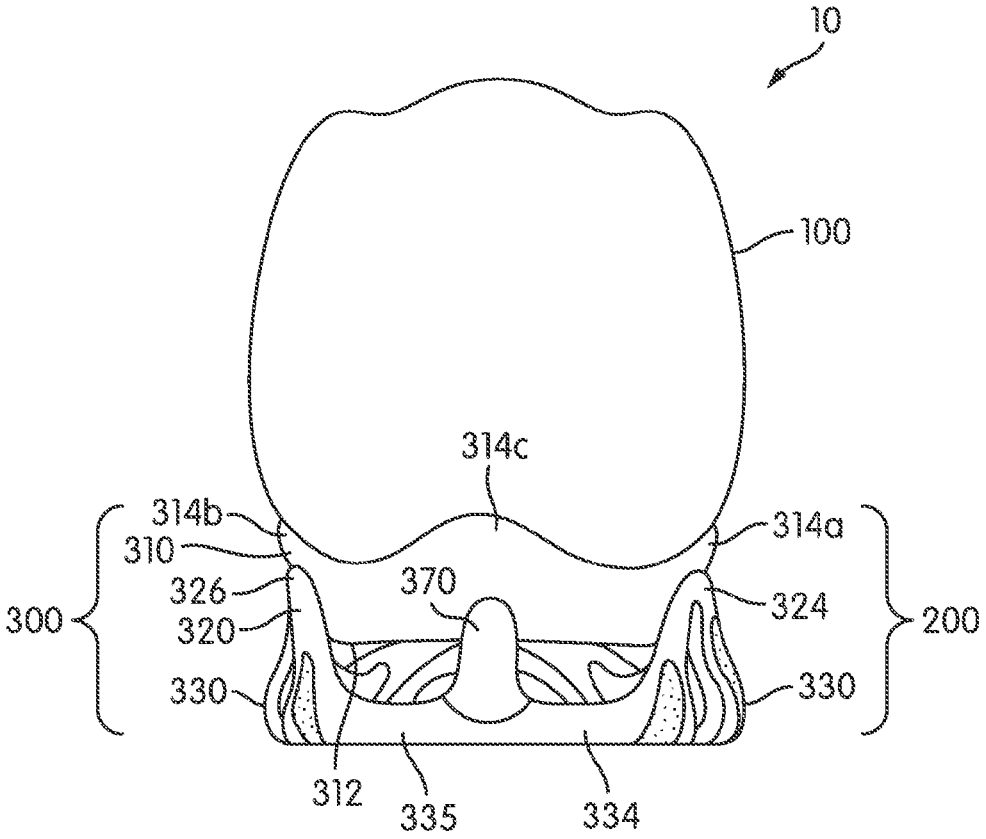
FIG. 1B is a rear view of the article of footwear of FIG. 1A.
Figure 1C:
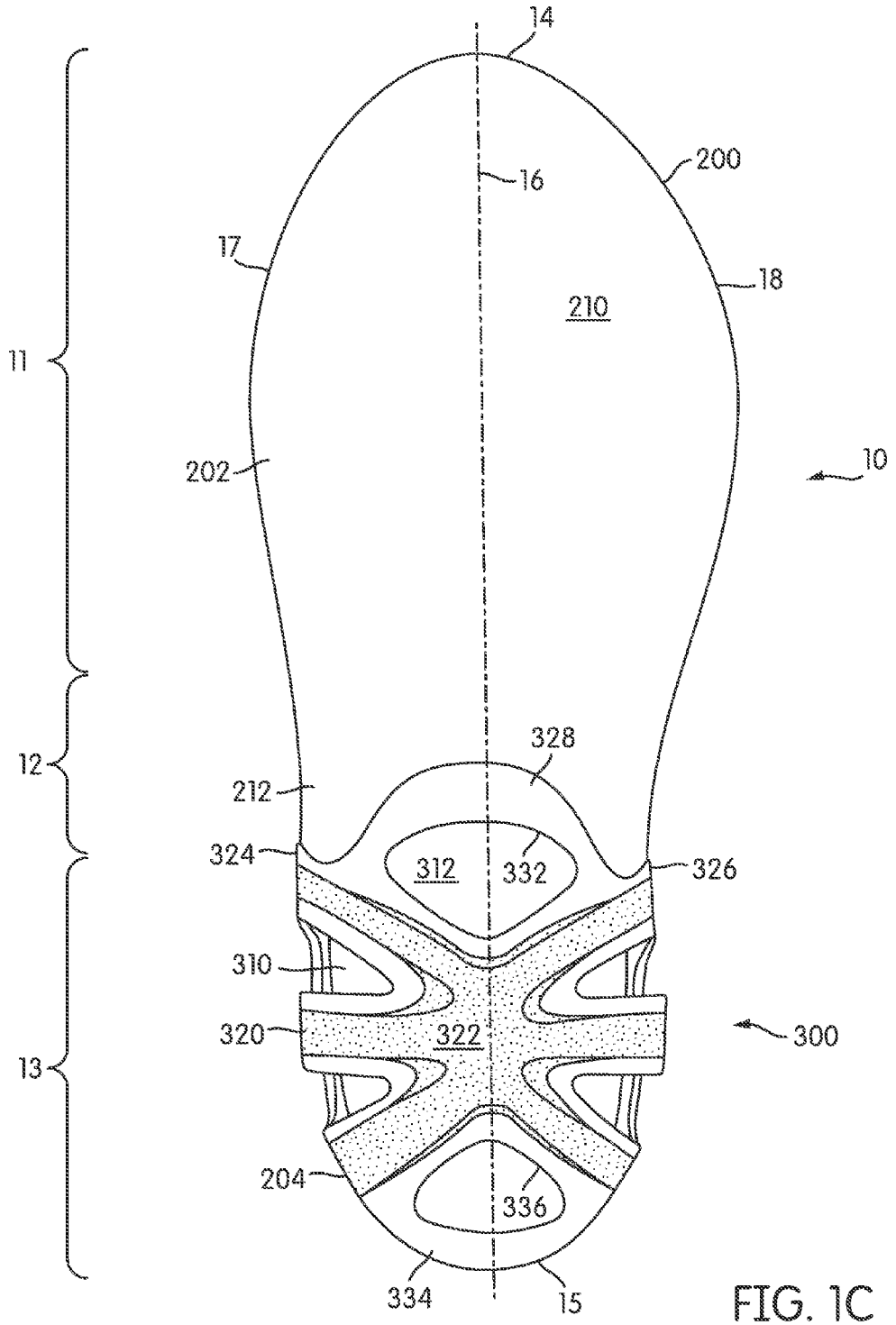
FIG. 1C is a bottom view of the article of footwear of FIG. 1A.

Referring to FIGS. 1A-1C, an article of footwear 10 generally includes two primary components: an upper 100 and a sole structure 200. Upper 100 is secured to sole structure 200 and forms a void on the interior of footwear 10 for comfortably and securely receiving a foot. Sole structure 200 is secured to a lower portion of upper 100 and is positioned between the foot and the ground. Upper 100 may include an ankle opening that provides the foot with access to the void within upper 100. As is conventional, upper 100 may also include a vamp area having a throat and a closure mechanism, such as laces.

Referring to FIG. 1C, typically, sole structure 200 of the article of footwear 10 has a forefoot region 11, a midfoot region 12 and a heel region 13. Although regions 11-13 apply generally to sole structure 200, references to regions 11-13 may also apply to the article of footwear 10, upper 100, sole structure 200, or an individual component within either sole structure 200 or upper 100.

Sole structure 200 of the article of footwear 10 further has a toe or front edge 14 and a heel or back edge 15. A lateral edge 17 and a medial edge 18 each extend from the front edge 14 to the back edge 15. Further, sole structure 200 of the article of footwear 10 defines a longitudinal centerline 16 extending from the back edge 15 to the front edge 14 and located generally midway between the lateral edge 17 and the medial edge 18. Longitudinal centerline 16 generally bisects sole structure 200, thereby defining a lateral side and a medial side.

According to certain aspects and referring to FIGS. 1A-1C, sole structure 200 includes a forward portion 202 and a rearward portion 204. Forward portion 202 may encompass forefoot region 11 and some or all of midfoot region 12. Rearward portion 204 may encompass heel region 13 and some or all of midfoot region 12. Thus, some portion of forward portion 202 and/or rearward portion 204 of sole structure 200 may be located in the midfoot region 12. In this particular configuration, forward portion 202 includes a conventional midsole structure 220 and a conventional outsole structure 210. Rearward portion 204 includes a support assembly structure 300.

Referring to FIG. 1A, sole structure 200 may include multiple layers and/or multiple components. For example, forward portion 202 may include an outsole structure 210 and a midsole structure 220, and may include an insole (not shown). Outsole structure 210 forms the ground-engaging portion (or other contact surface-engaging portion) of sole structure 200, thereby providing traction and a feel for the engaged surface. Outsole structure 210 may also assist in providing stability and localized support for the foot. Even further, outsole structure 210 (and in some instances, insole) may assist in providing impact force attenuation capabilities.

Outsole structure 210 may be formed of conventional outsole materials, such as natural or synthetic rubber or a combination thereof. The material may be solid, foamed, filled, etc. or a combination thereof. One particular rubber for use in outsole structure 210 may be a solid rubber having a typical Shore A hardness of between 74-80. The rubber may be a natural rubber, a synthetic rubber or a combination thereof. As an example, a particular composite rubber mixture may include approximately 75% natural rubber and 25% synthetic rubber such as a styrene-butadiene rubber. Other suitable polymeric materials for the outsole structure include plastics, such as PEBAX® (a poly-ether-block copolyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, outsole structure 210 may also include fillers or other components to tailor its hardness, wear, durability, abrasion-resistance, compressibility, stiffness and/or strength properties. Thus, for example, outsole structure 210 may include reinforcing fibers, such as carbon fibers, glass fibers, graphite fibers, aramid fibers, basalt fibers, etc.

Further, outsole structure 210 may include a ground-contacting bottom layer. The ground-contacting bottom layer may be formed separately from the other portions of outsole structure 210 and subsequently integrated therewith. The ground-contacting bottom layer may be formed of an abrasion resistant material that may be co-molded, laminated, adhesively attached or applied as a coating to form a lower surface of outsole 210.

Referring back to FIG. 1A, forward portion 202 of sole structure 200 also may include a midsole structure 220. Midsole structure 220 may be positioned between outsole structure 210 and upper 100. Midsole structure 220 may be secured to upper 100 along the lower length of the upper 100 in any conventionally known manner (e.g., via adhesive, stitching, co-molding, etc.).

In general, a conventional midsole structure may have a resilient, polymer foam material, such as polyurethane or ethylvinylacetate. The foam may extend throughout the length and width of the forward portion 202. In general, a relatively thick foam layer will provide greater impact force attenuation than a relatively thin foam layer, but it will also have less stability than the relatively thin foam layer. Optionally, a midsole structure may incorporate sealed chambers, fluid-filled bladders, channels, ribs, columns (with or without voids), etc.

The optional insole (or sockliner), is generally a thin, compressible member located within the void for receiving the foot and proximate to a lower surface of the foot. Typically, the insole, which is configured to enhance footwear comfort, may be formed of foam, and optionally a foam component covered by a moisture wicking fabric or textile material. Further, the insole or sockliner may be glued or otherwise attached to the other components of sole structure 200, although it need not be attached, if desired.

According to certain aspects and referring to FIGS. 1A-1C, rearward portion 204 of sole structure 200 includes support assembly structure 300. According to certain aspects, support assembly structure 300 may decouple, or at least partially decouple, a vertical compressive stiffness characteristic from a lateral stiffness characteristic.

According to the particular embodiment illustrated in FIGS. 1A-1C, support assembly structure 300 may include a flexure element 320 and an upper support element 310. Upper support element 310 is located above flexure element 320. Further, upper support element 310 may be attached to a lower surface of upper 100. Optionally, upper support element 310 may be attached to a midsole element 220. Even further, upper support element 310 may be integrally (or even unitarily) formed with a midsole element 220. Lower surfaces of flexure element 320 may form a portion of the ground-contacting surface of footwear 10. Optionally, as described in more detail below, an outsole structure 210 may be positioned below flexure element 320. In some embodiments, flexure element 320 may be attached to an upper surface of outsole structure 210.

With particular reference to FIGS. 2A through 2G and FIG. 3, flexure element 320 may include a central portion 322, a lateral flange 324 and a medial flange 326. Central portion 322 extends from a lateral lower edge 323 to a centrally located portion or region 321*a* and then to a medial lower edge 325. Region 321*a* may have a downwardly concavely-curved shape. Central portion 322 is joined to flanges 324, 326 at edges 323, 325, respectively. Lateral flange 324 extends upward in a generally vertical direction from lateral edge 323. Medial flange 326 extends upward in a generally vertical direction from medial edge 325. Flexure element 320 may have a constant thickness or portions of the flexure element 320 may be provided with a varying thickness so as to develop specific stiffness and/or strength characteristics.

Figure 2A:
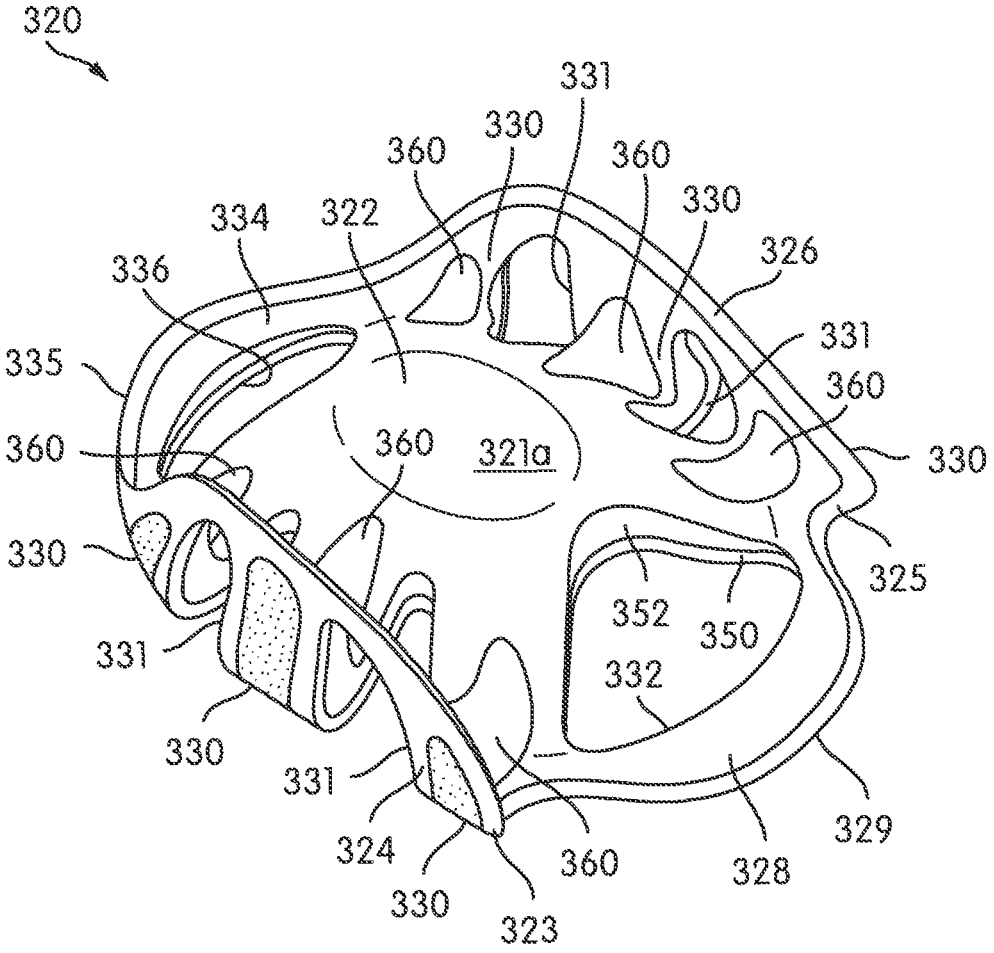
FIG. 2A is a top perspective view of a flexure element in accordance with aspects of this disclosure.
Figure 2B:
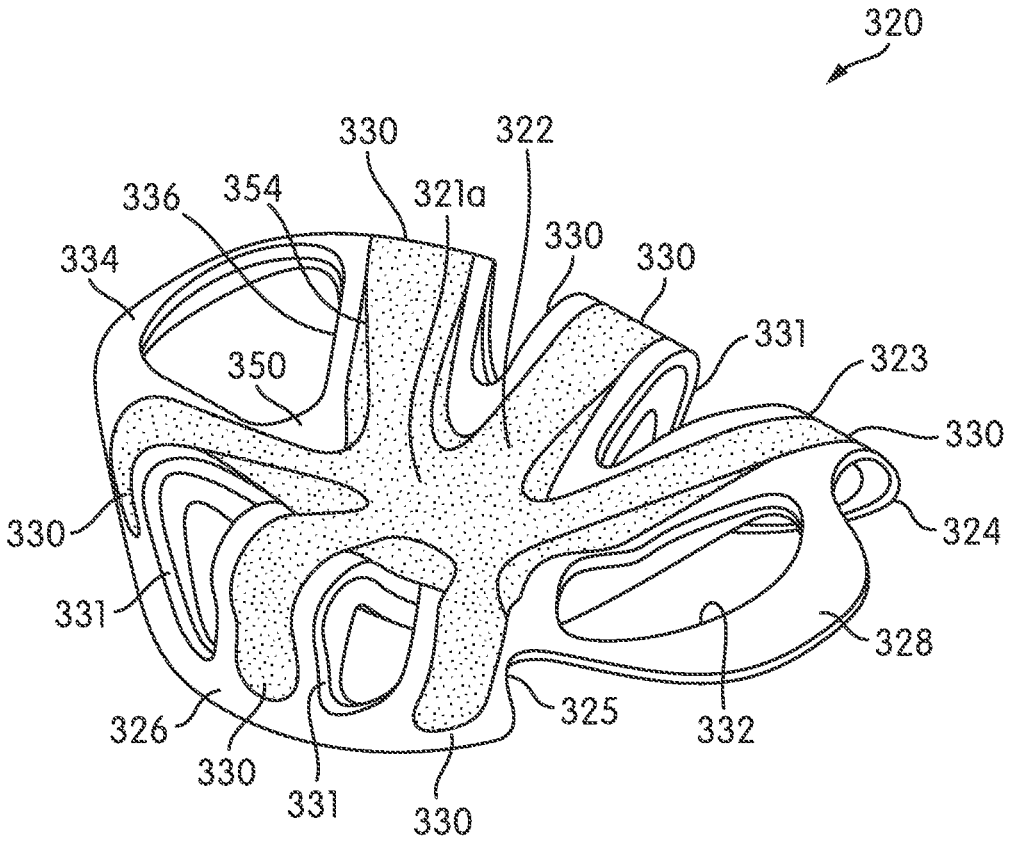
FIG. 2B is a bottom perspective view of the flexure element of FIG. 2A.
Figure 2C:
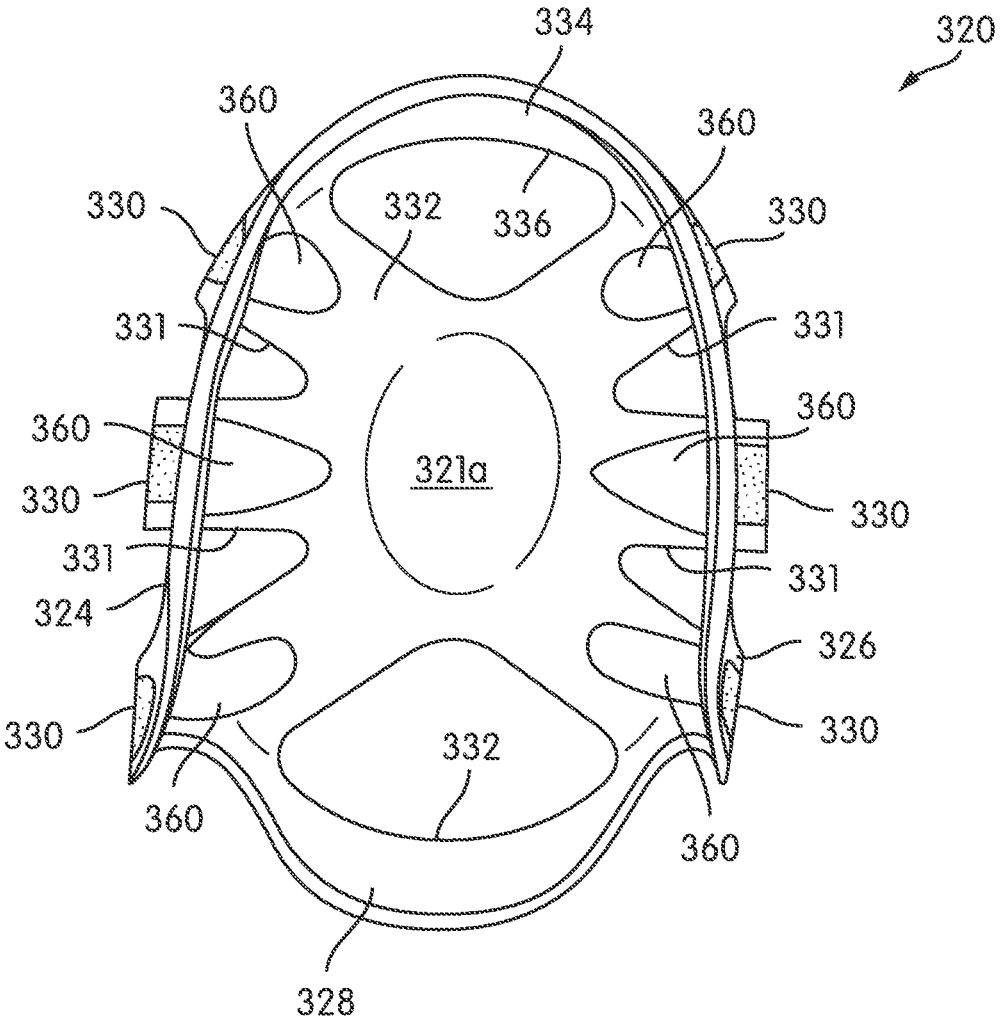
FIG. 2C is a top view of the flexure element of FIG. 2A.
Figure 2D:
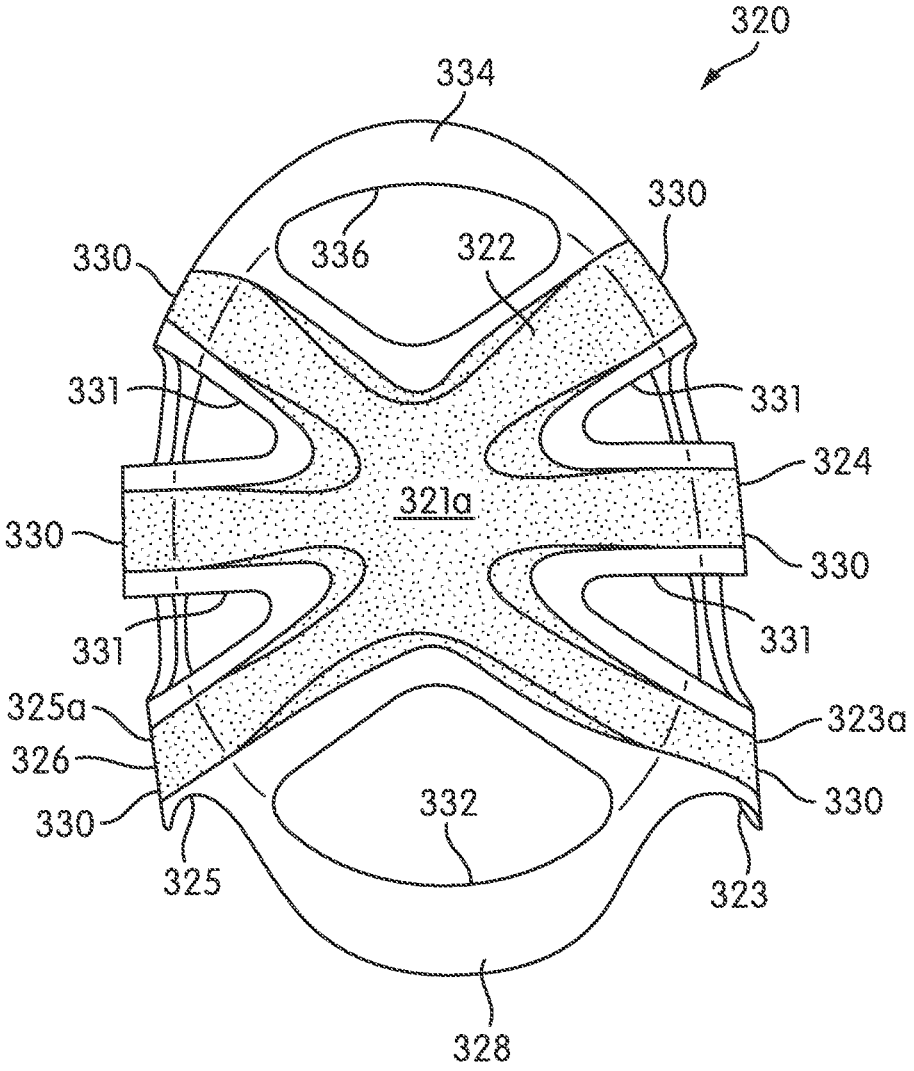
FIG. 2D is a bottom view of the flexure element of FIG. 2A.
Figure 2E:
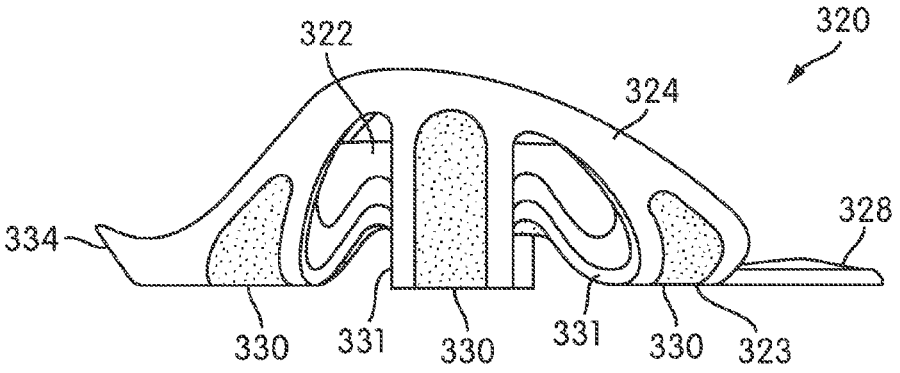
FIG. 2E is a medial side view of the flexure element of FIG. 2A.
Figure 2F:
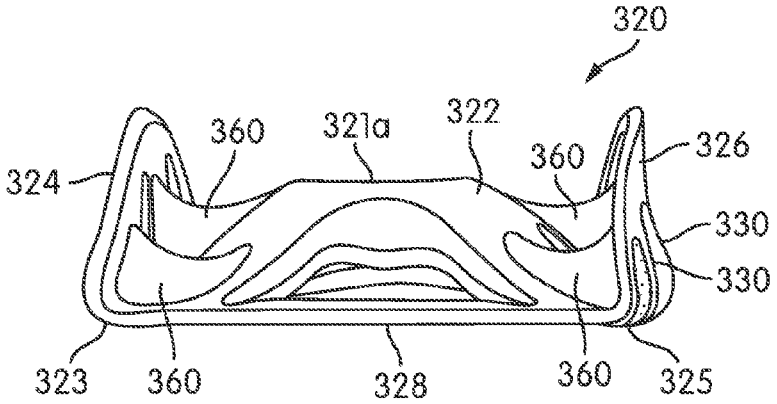
FIG. 2F is a front view of the flexure element of FIG. 2A.
Figure 2G:
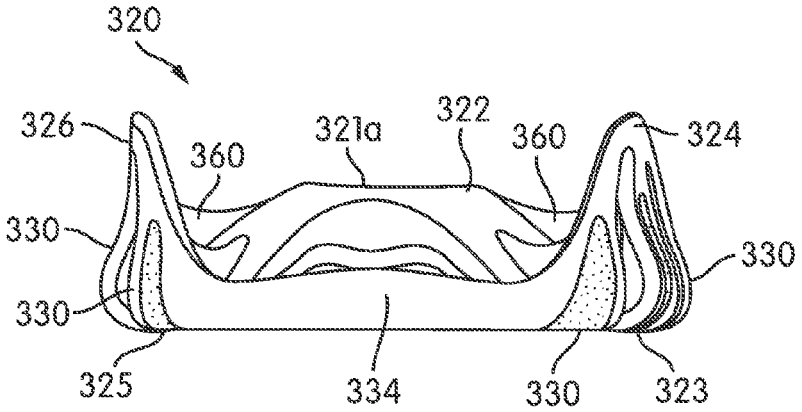
FIG. 2G is a back view of the flexure element of FIG. 2A.
Figure 3:
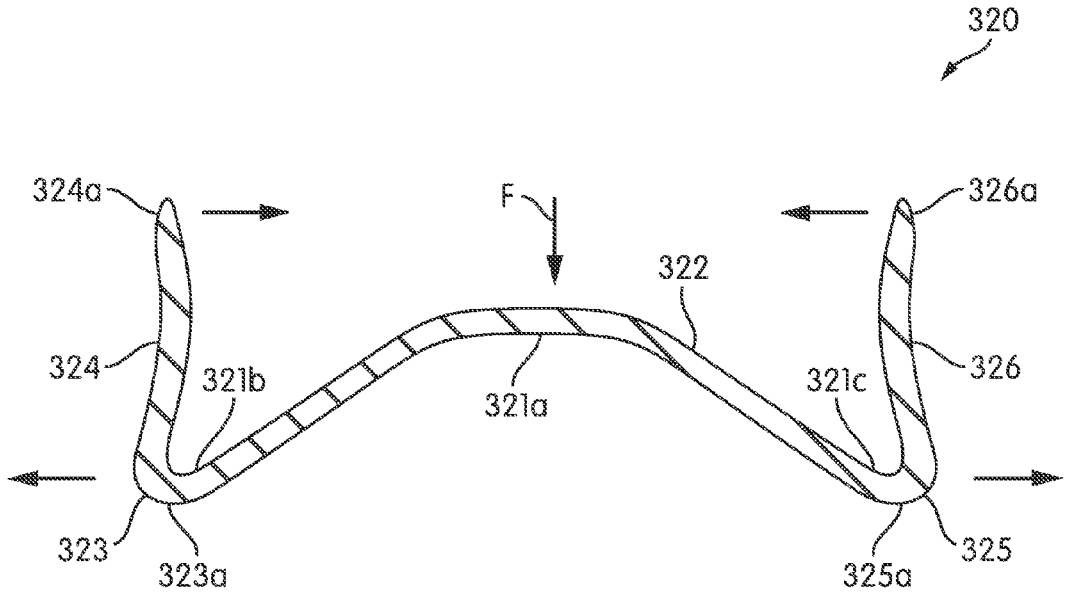
FIG. 3 is a schematic cross-section of a flexure element in accordance with aspects of this disclosure.

As shown in the embodiment of FIGS. 1-3 and referring in particular to FIG. 3, lower edges 323 and 325 of flexure element 320 may be provided with ground-contacting surfaces 323*a*, 325*a*. Thus, in certain embodiments, lower edges 323, 325 may be considered to be ground-contacting regions. The lateral ground-contacting region formed by lower edge 323 may extend along a lateral side of support assembly structure 300 (and of the article of footwear 10). The medial ground-contacting region formed by lower edge 325 may extend along a medial side of support assembly structure 300 (and of the footwear 10).

At a front edge of flexure element 320, and referring in particular to FIGS. 1C and 2A-2F, a relatively flat portion or landing 328 may be provided. Central portion 322 may be separated from a leading edge 329 of landing 328 by a front cutout 332. At a rear edge of flexure element 320 a platform 334 may be provided. Central portion 322 may be separated from platform 334 by a rear cutout 336. Platform 334 may include a flange 335 for additional stiffness or strength. Landing 328 and/or platform 334 may provide a footprint for mounting (or attaching) flexure element 320 to the remainder of the sole structure 200. In addition, landing 328 and/or platform 334 may provide a measure of front-to-rear rocking stability. Optionally, landing 328 and/or platform 334 may prevent or inhibit excessive splaying of the lower edges 323, 325 when the center region of flexure element 320 is subjected to vertical compressive loading (F) (see FIG. 3).

Referring to FIGS. 2A-2G, flexure element 320 may be formed as a curved, generally shell-like element. For example, central portion 322 of flexure element 320 may be concavely-curved downward in a side-to-side lateral direction. Still referring to FIGS. 2A-2G, central portion 322 of flexure element 320 may be formed as a complexly-curved, generally shell-like element. For example, central portion 322 and in particular region 321*a* may be concavely-curved downward in both a side-to-side lateral direction and a front-to-rear longitudinal direction. The degree of curvature may be the same or different in the two orthogonal, transverse directions. Similarly, central portion 322 may be convexly-curved upward in the side-to-side lateral direction and/or may be convexly-curved upward in the front-to-rear longitudinal direction. In addition, the upward facing surface of region 321*a* may be flattened to provide a planar footprint for contacting upper support element 310.

According to certain aspects and referring to FIG. 3, in the lateral side-to-side direction, flexure element 320 may be generally concavely-curved downward in central region 321*a* and generally concavely-curved upward in side regions 321*b*, 321*c* adjacent at least one of the lateral lower edge 323 or medial lower edge 325. Thus, for example, flexure element 320 may have a "recurved" or "S-shaped" cross-section as it extends in the lateral side-to-medial side direction. According to some aspects, flexure element 320 may be generally concavely-curved upward at both its lateral lower edge 323 and at its medial lower edge 325. Thus, flexure element 320 may have a "doubly-recurved" cross-section (much like a recurved bow) as it extends in the lateral direction.

Still referring to FIG. 3, when a sufficient force (F) is applied downward to the downwardly concavely-curved portion 321*a* (for example, by the heel of a user's foot within the article of footwear), portion 321*a* moves downward, lateral and medial lower edges 323, 325 may splay or slide laterally outward, and the upper edges 324*a*, 326*a* of flanges 324, 326 may move (or press) laterally inward.

One or more legs 330 may be provided where central portion 322 is joined to lateral and medial flanges 324, 326. In other words, lower edges 323 and 325 may be discontinuous due to cutouts 331, such that a plurality of legs may extend across the lower-most ground-contacting regions. As illustrated in FIGS. 2A-2G, legs 330 may extend into and form part of central portion 322. Further, legs 330 may extend into and form part of the generally vertically-oriented flanges 324, 326.

In FIGS. 2A-2G, a total of six legs 330 are illustrated, three each on the medial and lateral sides. Alternatively, any number of legs could be provided at the juncture of central portion 322 with lateral and medial flanges 324, 326. For example, a single leg may be provided on each side, multiple legs may be provided on each side with the same number of legs on each side, or multiple legs may be provided on each side with a different number of legs on each side. Each of legs 330 need not have the same length, width or thickness dimensions. According to some embodiments, a flexure element 320 having legs 330 may be considered to be a "spider" element. As shown in FIGS. 2A-2G, at the upper edge of flanges 324, 326 the ends of legs 330 may be joined together. Optionally, one or more of the legs 330 may extend upward without being joined to the other legs 330. Thus, in certain embodiments (not shown), each flange 324, 326 may be formed as a plurality of distinct, individual legs 330.

Upper support element 310 may be formed as a separate component, as a portion of midsole structure 220, or as a portion of upper 100. When formed as a separate element, upper support element 310 may be joined to midsole structure 220 and/or upper 100 as conventionally known in the art (e.g., via adhesives, thermal bonding, co-molding, stitching, etc.). Upper support element 310 provides a platform for a user's foot to bear on flexure element 320.

As shown in FIGS. 1A-1C, upper support element 310 may extend from the rear edge 15 into the midfoot region 12 of footwear 10. In this particular embodiment, upper support element includes a plate element 312 having lateral, medial and/or heel flanges 314 extending around the perimeter thereof. Plate element 312 may be generally horizontally oriented and may conform or generally conform to the corresponding contours of a user's foot. Lateral flanges 314*a* and medial flange 314*b* may extend all or part of the way along the side edges of plate element 312. Heel flange 314*c* may extend all or part of the way across the back edge of the heel. Thus, according to certain aspects, upper support element 310 may be formed as a heel cup. Flanges 314*a*, 314*b*, 314*c* may be used to stabilize the user's foot and to provide an attachment surface to a vertical portion of the article of footwear. In addition, as discussed below, lateral flange 314*a* and medial flange 314*b* may contact and interact with flanges 324, 326, respectively, of flexure element 320. Heel flange 314*c* may be joined to platform 334 of flexure element 320 via a vertical columnar or plate-like element, for example, pillar 370.

Upper support element 310 may also be joined at its front end to midsole 220, to outsole 210, and/or to a front end of flexure element 320 (e.g, landing 328). As illustrated in FIG. 1A, the forward portion 316 of upper support element 310 curves downward to cradle a rear edge of midsole structure 210. A rear portion 212 of outsole 210 extends beneath this forward portion 316 of upper support element 310 and is joined thereto. Additionally, in this particular embodiment, the forward portion 316 of upper support element 310 curls or extends backward so as to engage landing 328 of flexure element 320. In this particular embodiment, the rear portion 212 of outsole 210 is positioned between forward portion 316 of upper support element 310 and landing 328 of flexure element 320.

Thus, referring to the embodiment illustrated in FIGS. 1A-1C, flexure element 320 may be attached to the remainder of the article of footwear 10 (or the remainder of sole structure 200) at the front end or landing 328 of flexure element 320. In this instance, landing 328 is joined to a portion of the outsole structure 210 located in the midfoot region 12. Flexure element 320 may be attached to outsole structure 210 (and/or optionally to other portions of sole structure 200) in any suitable known fashion. Optionally, flexure element 320 may remain detached from outsole structure 210.

As noted above and as illustrated in FIGS. 1A-1B, flexure element 320 may be attached to the remainder of footwear 10 at its back end. Specifically, platform 334 may be joined to a rearward portion of upper support element 310 with a column or pillar 370. In this embodiment, platform 334 includes an elongated, curved flange 335 extending along the rear edge, such that platform 334 has an "angle-type" cross-section for improved stiffness. Pillar 370 may extend upward from platform 334 (from flange 335) to join with the lower rear edge of upper support element 310 and/or optional to join with a rearward region of upper 100. Pillar 370 may generally be located on the longitudinal axis 16 or otherwise approximately centered from side-to-side of the footwear 10. Further, pillar 370 may be relatively flexible such that loads in the vertical compressive direction cause pillar 370 to flex and shorten such that the upper support element 310 may move relative to flexure element 320. Referring also to FIG. 1C, cutouts 332 and 336 may function to decouple central portion 322 from landing 328 and/or platform 334 of flexure element 320 to the remainder of footwear 10. Thus, if landing 328 and/or platform 334 are fixedly joined to the remainder of footwear, cutouts 332 and/or 336 serve to isolate central portion 322 from such hard attachment points.

Referring now also to the embodiment shown in FIGS. 4A-4F, sole structure 200 includes an outsole structure 210, a midsole structure 220 and a support assembly structure 300. In the particular embodiment of FIGS. 4A-4F, outsole structure 210 extends as a single, continuous layer from the front edge 14 to the back edge 15 of footwear 10. Support assembly structure 300, including upper support element 310 and flexure element 320, is positioned on top of the rear portion of outsole structure 210. Upper support element 310 extends from the lateral edge to the medial edge of heel region 13. Further, upper support element 310 extends from the rearward edge of heel region 13 forward toward midfoot region 12. Flexure element 320, located below upper support element 310, may be attached at its front end (e.g. at landing 328) to outsole structure 210 in any known fashion. Similarly, flexure element 320 may be attached at its back end (e.g., at platform 334) and/or at its sides (e.g., at lower edges 323, 325) to outsole structure 210 in any known fashion. Additionally, the lower surface of the outsole structure 210 may be provided with a suitable ground engaging surface such that the desired traction of the outsole structure 210 (and thereby of the footwear) to the ground may be provided.

Optionally, one or more of the lower edges 323, 325 (or portions thereof) of flexure element 320 may be in contact with the upper surface of outsole structure 210, but may be free to slide relative to this upper surface. Thus, by judicious choice of materials, the frictional resistance to the lower edges 323, 325 sliding relative to outsole structure 210 may be controlled. As non-limiting examples, suitable materials for the lower edges 323, 325 of flexure element 320 may include natural and/or synthetic rubbers, such as a styrene-butadiene rubber or a nylon/rubber blend, PEBAX®, silicone, silicone blends, TPU, polypropylene, polyethylene, ethylvinylacetate, and styrene ethylbutylene styrene, etc. The material may be solid, foamed, filled, etc. Similarly, suitable materials for the upper surface of outsole structure 210 may include foamed or solid natural and/or synthetic rubbers, including styrene-butadiene rubber or nylon/rubber blends, PEBAX®, silicone, silicon blends, TPU, polypropylene, polyethylene, ethylvinylacetate, and styrene ethylbutylene styrene, etc. Coatings to enhance the relative coefficient of friction between flexure element 320 and outsole structure 210 may be applied to one or both sliding surfaces.

As illustrated in the embodiment of FIGS. 4A-4F, flexure element 320 need not be attached to upper support element 310 (or otherwise to the remainder of the footwear) at back edge 15. For example, in this specific embodiment, there is no pillar (or other support) coupling the rearward portion of upper support element 310 with the rear platform 334 of flexure element 320. Further, as illustrated in the particular embodiment of FIGS. 4A-4F, upper support element 310 extends into midfoot region 12 and is integrally formed (or optionally, co-molded) with a forward portion of midsole structure 220 located in forefoot region 11.

Figure 5A:
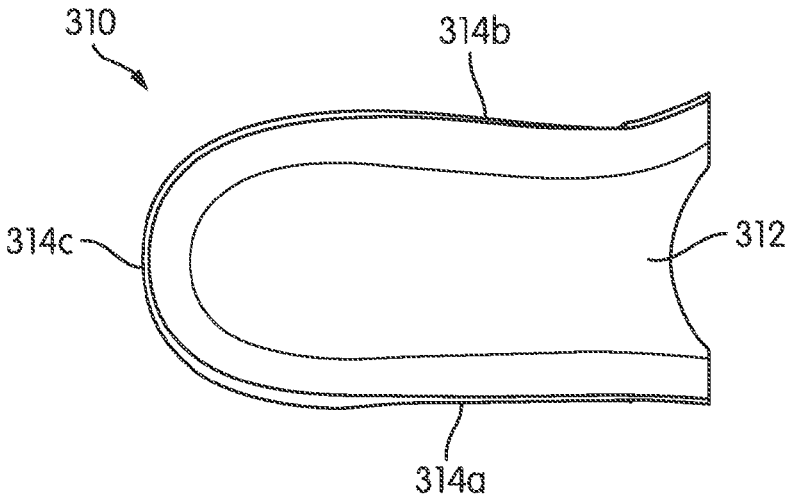
FIG. 5A is a top view of the upper support element of the sole structure of FIG. 4A.
Figure 5B:
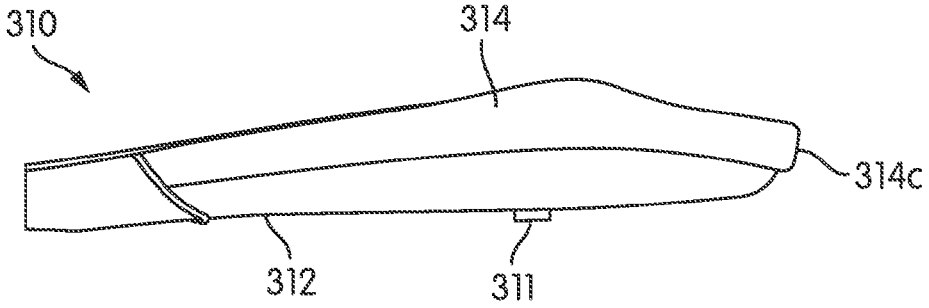
FIG. 5B is a medial side view of the upper support element of FIG. 5A.

Referring now to FIGS. 5A and 5B, upper support element 310 may be generally formed as a heel cup and may include a generally horizontal plate 312, a lateral sidewall or flange 314*a* and a medial sidewall or flange 314*b*. Plate 312 may be substantially planar, and further, plate 312 may substantially follow the contour of the sole of a foot. Plate 312 may have a relatively constant thickness. Optionally (not shown), plate 312 may have a relatively thickened or built-up pad beneath a central load-bearing area of the heel of the user. In certain embodiments (not shown), a pad may be formed separately and subsequently integrated with or otherwise joined to plate 312. Even further, as shown in FIG. 5B, upper support element 310 may include a positioning stub 311 on its lower surface for insertion into a complementary positioning recess (not shown) in the upper surface of flexure element 320. Positioning stub 311 may facilitate assembly of the support assembly structure 300 and further may serve to retain upper support element 310 centered over flexure element 320.

Still referring to FIGS. 5A and 5B, lateral sidewall flange 314*a* of upper support structure 310 extends at least partially along the length of the lateral edge of plate 312 and projects upward from plate 312. Similarly, medial sidewall flange 314*b* extends at least partially along the length of the medial edge of plate 312. Upper support element 310 may also include a back wall or heel flange 314*c* that extends at least partially along the length of the back edge of plate 312. Further, according to certain embodiments, lateral flange 314*a*, heel flange 314*c* and medial flange 314*b* may be joined together so as to form a single continuous wall around the heel region. Optionally (not shown), upper support element 310 may include flanges that project downward from plate 312.

Figure 4A:
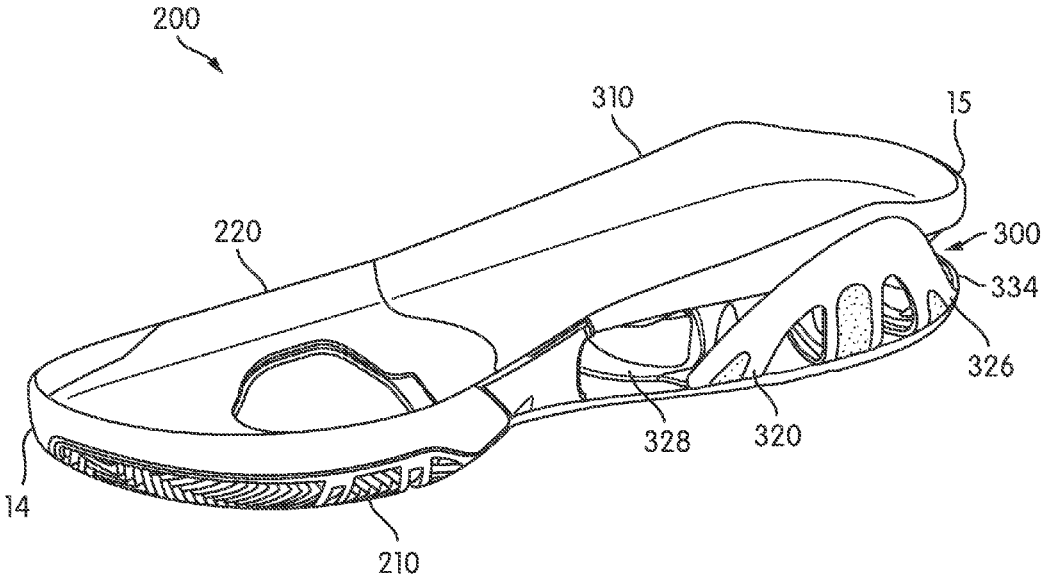
FIG. 4A is a top perspective view of a sole structure in accordance with aspects of this disclosure.
Figure 4B:
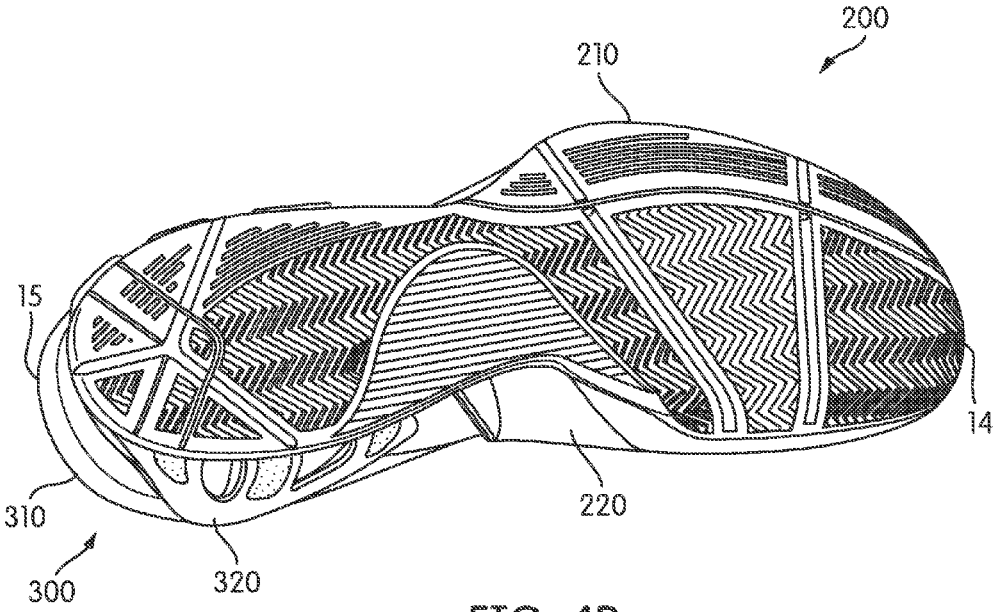
FIG. 4B is a bottom perspective view of the sole structure of FIG. 4A.
Figure 4C:
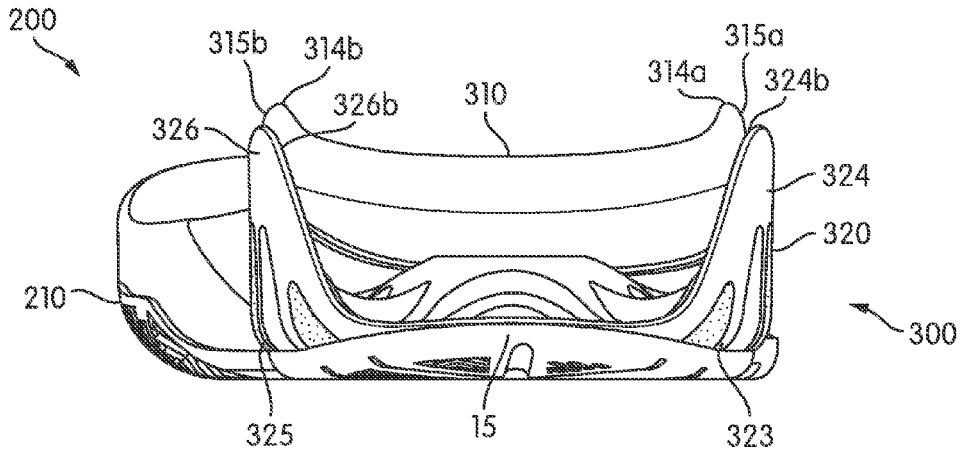
FIG. 4C is a back perspective view of the sole structure of FIG. 4A.
Figure 4D:
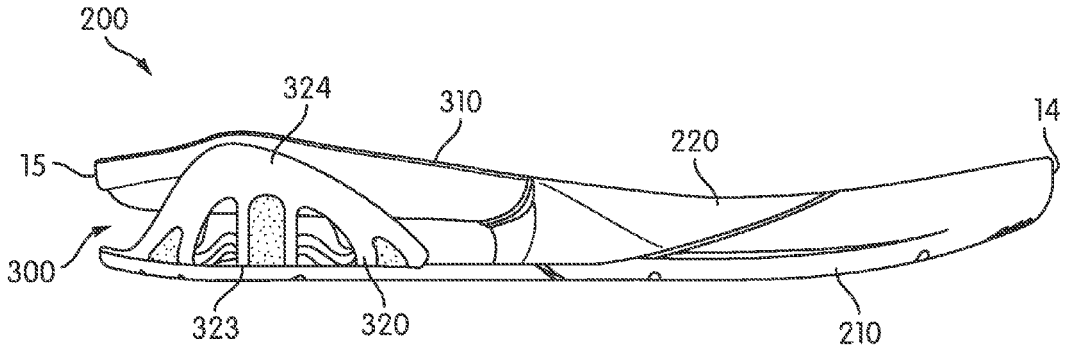
FIG. 4D is a lateral side perspective view of the sole structure of FIG. 4A.
Figure 4E:
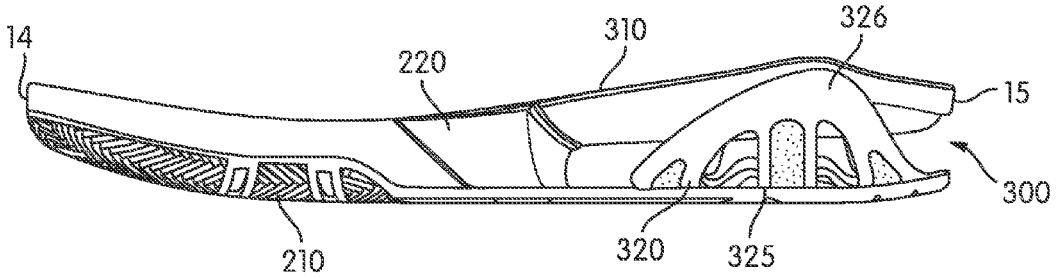
FIG. 4E is a medial side perspective view of the sole structure of FIG. 4A.
Figure 4F:
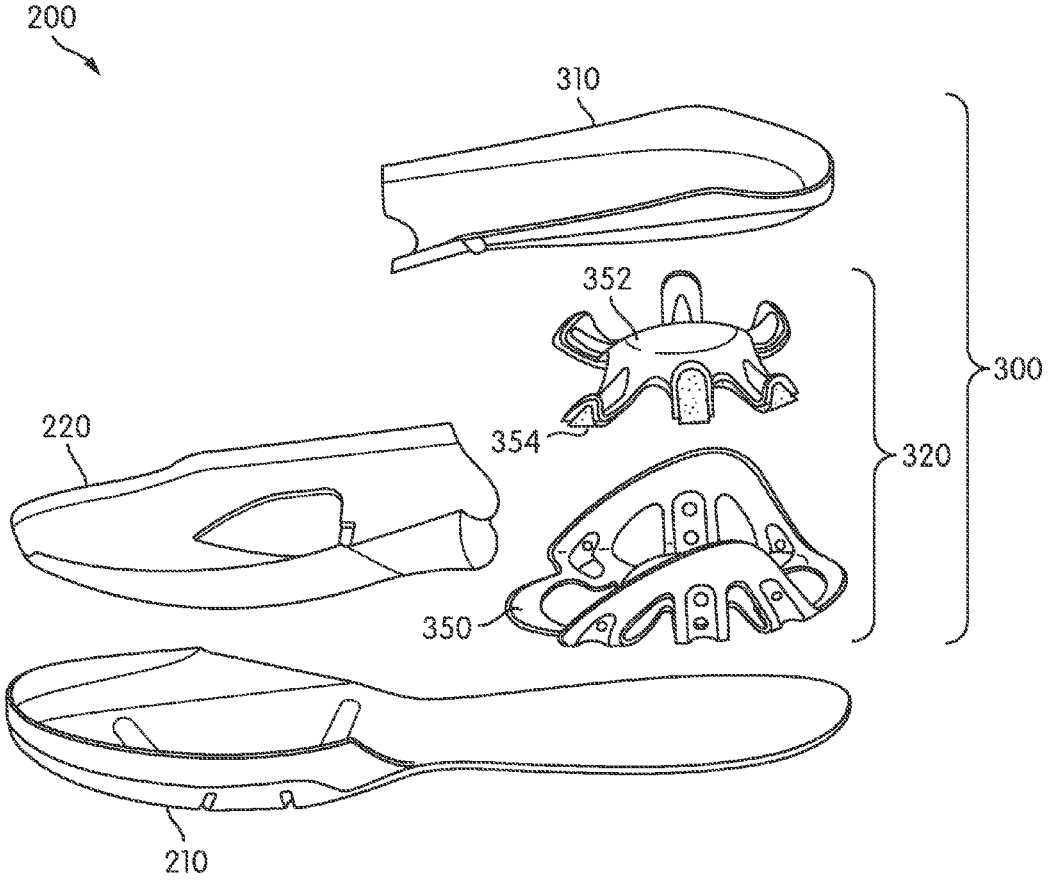
FIG. 4F is an exploded top perspective view of the sole structure of FIG. 4A.

As best shown in FIGS. 1A and 1B and in FIGS. 4A and 4D, upper support element 310 may be positioned above the central portion 322 of flexure element 320. In the unloaded configuration, the lower surface of plate 312 of upper support element 310 may be in contact with the upper convexly-curved surface of central portion 321*a* of flexure element 320. Alternatively, in the unloaded configuration, the lower surface of plate 312 of upper support element 310 may be positioned above and spaced from the upper convexly-curved surface of central portion 321*a* of flexure element 320.

Further, upper support element 310 may be positioned between flanges 324, 326 such that the lateral and medial outer side surfaces of upper support element 310 contact flanges 324, 326 of flexure element 320. Alternatively, in the unloaded configuration, the outer surface of lateral sidewall 314*a* of upper support element 310 may be spaced from the inner surface of lateral flange 324 of flexure element 320. Similarly, the medial surfaces of upper support element 310 and flexure element 320 may also be initially spaced apart (i.e., in the unloaded configuration). In any event, upper support element 310 may slidably engage or interface with flanges 324, 326 of flexure element 320 when a vertical compressive load is applied to upper support element 310.

Support assembly structure 300 has a multi-regime vertical stiffness characteristic. At different times during the application of a vertical compressive load, support assembly structure 300 provides different load paths as its components engage one another and/or as its individual components deflect and assume new configurations. When a user's foot applies a vertical compressive load to the portion of the footwear 10 in the region of upper support element 310, downward movement of upper support element 310 (and thus, also of upper 100) causes the lower surface of plate 312 to contact flexure element 320, if it is not already in contact, or to displace flexure element 320, if it is already in contact. This initial downward movement of upper support element 310 also results in a corresponding downward displacement of lateral and medial sidewall flanges 314*a*, 314*b* of upper support element 310 relative to lateral and medial flanges 324, 326, respectively, of flexure element 320. If the medial and/or lateral sidewalls of upper support element 310 and the medial and/or lateral flanges of flexure element 320 are in contact during this relative downward displacement, then a vertical frictional resistance is developed. Further downward displacement of upper support element 310 may cause plate 312 to bear down against the top surface of central portion 321 of flexure element 320. This may cause the concavely-curved portion 321*a* of flexure element 320 to start to flatten out, while at the same time the lower lateral and medial edges 323, 325 of flexure element 320 may start to displace laterally outward (i.e., away from the longitudinal centerline 16). As flexure element 320 flattens out and edges 323, 325 move (or splay) outward, the recurved geometry of flexure element 320 may cause the upper edges 324*a*, 326*a* of flanges 324, 326 to move inward (i.e., toward the longitudinal centerline 16). This may result in a gripping or clamping load being applied by flexure element 320 to the lateral and medial sidewalls of upper support element 310. In turn, this may result in an increased resistance between upper support element 310 and flanges 324, 326 to relative vertical displacement of upper support element 310 and flexure element 320. Further, this also may result in a stiffening of central portion 322 as the lateral clamping of the upper edges 324*a*, 326*a* of flanges 324, 326 against upper support element 310 stops or inhibits the inward rotation of the flanges 324, 326 and therefore, limits further outward movement of the lower lateral and medial edges 323, 325. Thus, additional downward motion of upper support element 310 may meet with further resistance (i.e., an increased stiffness) due to the reluctance of the concavely-curved portion 321*a* to continue to flatten out and the inhibition of the outward movement of the lower edges 323, 325.

As noted above, during the application of a vertical compressive load lateral sidewall flange 314*a* of upper support element 310 may interact with lateral flange 324 of flexure element 320, and similarly, medial sidewall flange 314*b* of upper support element 310 may interact with medial flange 326 of flexure element 320. In the embodiment of FIGS. 4A-4F and as best shown in FIGS. 4C and 5B, lateral sidewall 314*a* of upper support element 310 may include an outer surface 315*a* that complementarily engages inner surface 324*b* of lateral flange 324 of flexure element 320, and similarly, medial sidewall 314*b* of upper support element 310 includes an outer surface 315*b* that complementarily engages with inner surface 326*b* of medial flange 326 of flexure element 320. According to some embodiments, one or both of the outer surfaces 315*a*, 315*b* of the lateral and medial sidewalls 314*a*, 314*b* of upper support element 310 may be canted, i.e., the outer surfaces may be formed as slightly off-vertical surfaces angling upward and outward. These angled or canted surfaces 315*a*, 315*b* may provide a sliding surface for the upper edges of flanges 324, 326 of flexure element 320, wherein the sliding resistance increases the more that the upper support element 310 moves downward relative to the flexure element 320. Optionally, one or both of the outer surfaces 315*a*, 315*b* may also be formed with stops (not shown) that limit the downward motion of the upper support element 310 relative to the flexure element 320. Such stops may be formed as protruding ridges or overhangs on the outer surfaces of the medial sidewalls 314*a*, 314*b*. Thus, as a vertical compressive load is applied in the heel region 13, upper support element 310 (along with upper 100) moves vertically relative to flanges 324 and 326 of flexure element 320. As described above, this vertical motion of upper support element 310 relative to flexure element 320 may be accompanied by a sliding and/or clamping contact between sidewall 314*a* and flange 324 and/or sidewall 314*b* and flange 326. After a certain predetermined amount of relative vertical displacement has occurred, further motion may be limited by a stop.

In certain embodiments, under increased vertical compressive load, the downwardly concavely-curved portion 321*a* of flexure element 320 may elastically buckle. For purposes of this disclosure, "buckling" refers to the occurrence of a relatively large deflection of a structure subjected to a compression load upon a relatively small increase in the compression load. Such buckling may include "snap-through" behavior and may occur when the lower edges 323, 325 are prohibited from sliding outward, yet at the same time, the upper support element 310 continues to press down on the top of the concavely-curved portion 321*a*.

Support assembly structure 300 not only has a multi-regime vertical stiffness characteristic, but it also has a multi-regime lateral stiffness characteristic. When a user's foot applies a lateral load to the portion of the footwear 10 in the region of upper support element 310 (such as when a cutting action takes place) sideways or lateral movement of upper support element 310 (and thus, also of upper 100)

causes the one of the lateral surfaces of upper support element 310 to contact the corresponding flange (324 or 326) of flexure element 320, if it is not already in contact. This initial lateral movement of upper support element 310 is generally accompanied by a vertical compressive load and the corresponding relative displacements discussed above with respect to upper support element 310 and flexure element 320. As the upper support element 310 laterally presses or bears against the inner surface of the corresponding flange (324 or 326) of the flexure element 320, the flange cantilevers outward. This outward cantilevering of the flange results in a corresponding load on the lower edge of the flange, such that the lower edge of the flange attempts to move inward (toward the longitudinal axis 16). Generally, however, the lower edge of the flange will be in contact with the ground (or the outsole 210), and further, due to the accompanying vertical load, the lower edge of this laterally loaded flange may be pressed firmly against the ground such that no inward motion could occur. Thus, lateral loads may be primarily reacted by the cantilever bending of the loaded flange of the flexure element. Further, as the accompanying vertical load causes flanges 324, 326 of flexure element 320 to engage and press against upper support element 310, as described above, the flange on the opposite side of the loading direction may also carry some of the lateral load. In other words, it is expected that lateral loads applied to upper support element 310 are reacted by bending of flanges 324, 326 of flexure element 320, with the majority of the load reacted by the flange bent outward.

From the above discussion, it becomes apparent that the load paths for reacting vertical compressive loads and lateral loads are essentially decoupled. Thus, for example, flexure element 320 of support assembly structure 300 may be designed with a stiff central portion 322 and relatively flexible flanges 324, 326 in bending. When greater lateral stability is desired, a flexure element 320 could be provided with the same central portion 322, but with much stiffer flanges 324, 326.

According to certain aspects and referring back to FIGS. 2A-2G, relatively stiff flanges 324, 326 could be provided by increasing the thickness of the flanges, increasing the stiffness of the material used to form the flanges, and/or decreasing the active height of the flanges (i.e., the distance from where the flanges 324, 326 contact the upper support element 310 to the lower surface of the flexure element 320). Conversely, relatively flexible flanges 324, 326 could be provided by decreasing the thickness of the flanges, decreasing the stiffness of the material used to form the flanges, and/or increasing the active height of the flanges. Further, providing cutouts in the flanges 324, 326 such that the lower edges 323, 325 become discontinuous and a plurality of legs 330 are provided will also decrease the stiffness of the flanges 324, 326. Even further, should the cutouts extend all the way to the upper edges 324*a*, 326*a* of the flanges, the ends of the legs 330 would not be joined together and this may also decrease the bending stiffness of the flanges 324, 326.

According to certain aspects, one or more gussets 360 may be provided to develop additional stiffness of the flexure element flanges 324, 326. Referring, for example, to FIGS. 2A, 2C, 2F and 2G, gussets 360 are shown extending between central portion 322 and flanges 324, 326. Specifically, in the illustrated embodiment, three gussets 360 are provided on the lateral side and three gussets 360 are provided on the medial side of flexure element 320. Optionally, just a single gusset 360 could be provided on each side; just a single gusset 360 could be provided on just one side with fewer or more gussets 360 provided on the other side; two gussets 360 could be provided on each side; two gussets 360 could be provided on one side with fewer or more gussets 360 provided on the other side; etc. Thus, any number of gussets 360 may be provided in each side (including no gussets).

Further, the gussets 360 need not have the same dimensions. Depending upon the degree of additional stiffness desired, the cross-sectional area of the individual gussets 360 could be the same, less than or greater than other gussets. For example, increasing the height of any individual gusset 360 would increase the stiffness of the attachment of the flange to central portion 322. Further, gussets 360 need not extend all the way down to the interior angle formed between the central portion 322 and the flanges 324, 326. Thus, optionally (not shown), gussets 360 may be formed as bridges extending from the central portion 322 to a flange 324, 326 and spanning the interior angle formed between the central portion 322 and the flange 324, 326.

Figure 6:
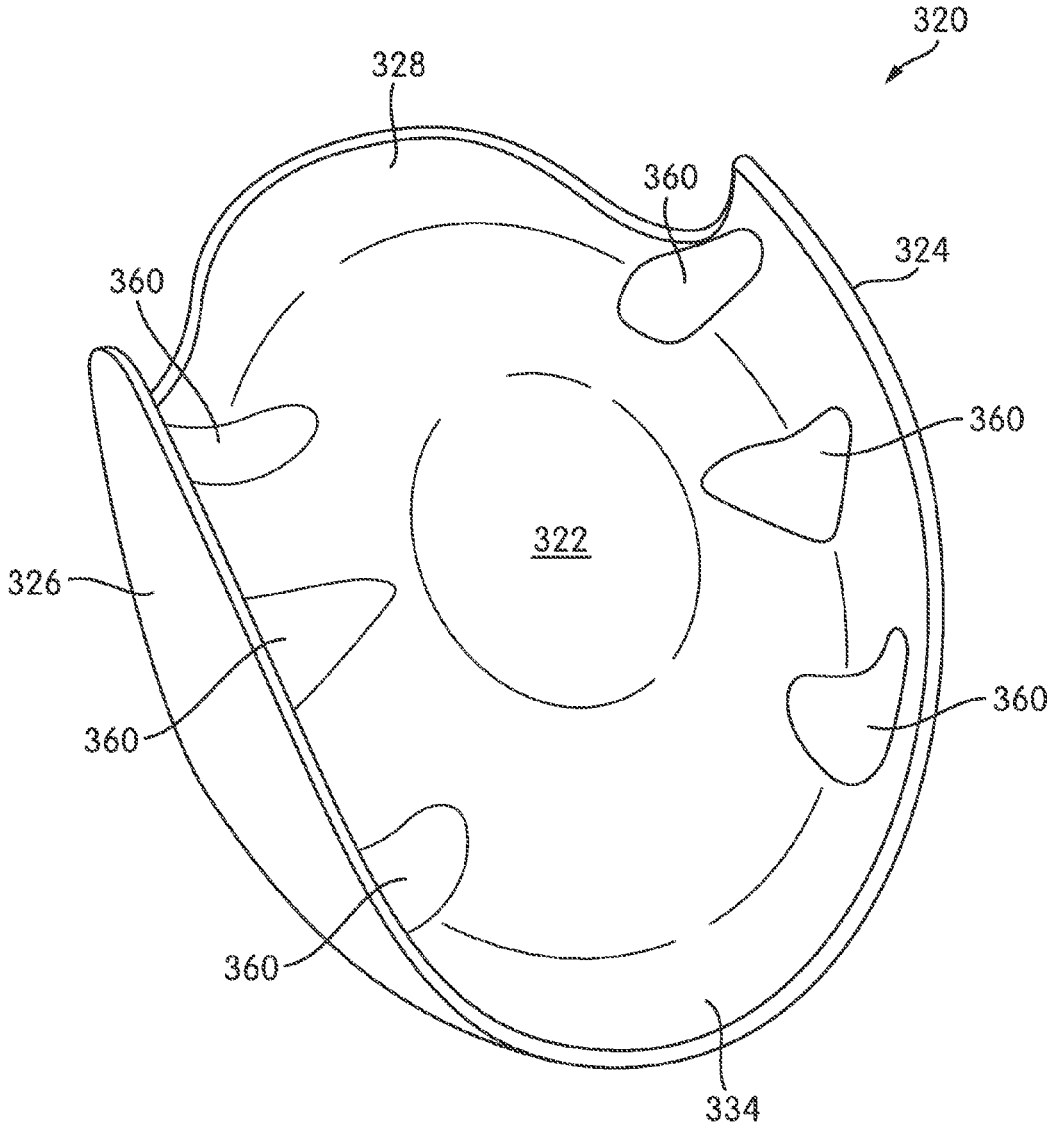
FIG. 6 is a top perspective view of a flexure element in accordance with other aspects of this disclosure.
Figure 7:
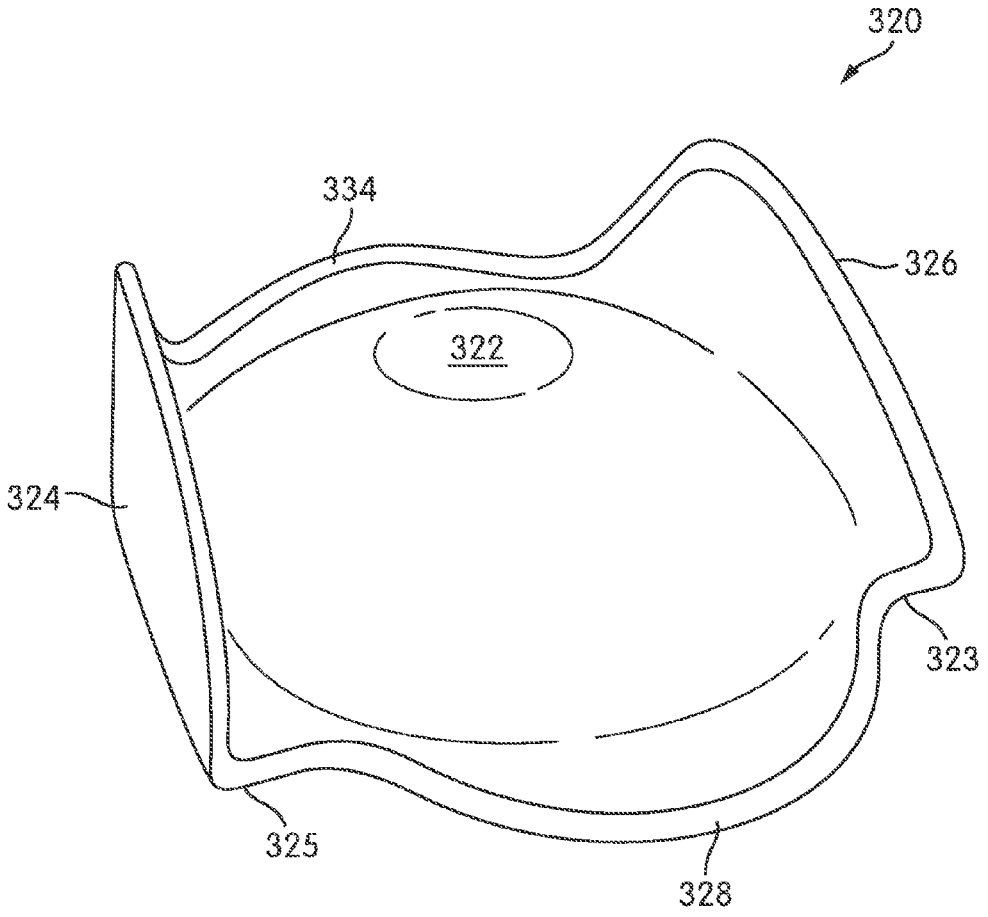
FIG. 7 is a top perspective view of a flexure element in accordance with further aspects of this disclosure.

According to further aspects and as illustrated in FIG. 6, flexure element 320 may be formed without leg cutouts (see cutouts 331 in FIG. 2A), without a front cutout (see cutout 332 in FIG. 2A) and/or without a rear cutout (see cutout 336 in FIG. 3A). According to other aspects and as illustrated in FIG. 7, flexure element 320 need not include gussets (see gussets 360 in FIG. 2A), although such a flexure element 320 could include leg cutouts (not shown in FIG. 7). Thus, in certain embodiments, flexure element 320 may include a central portion 322, a lateral flange 324 and a medial flange 326. The central portion 322 may be formed as a doubly-recurved plate in the lateral (side-to-side) direction. Flanges 324, 326 extend upward in a generally vertical direction from the lower lateral edges 323, 325 of central portion 322.

Figure 8:
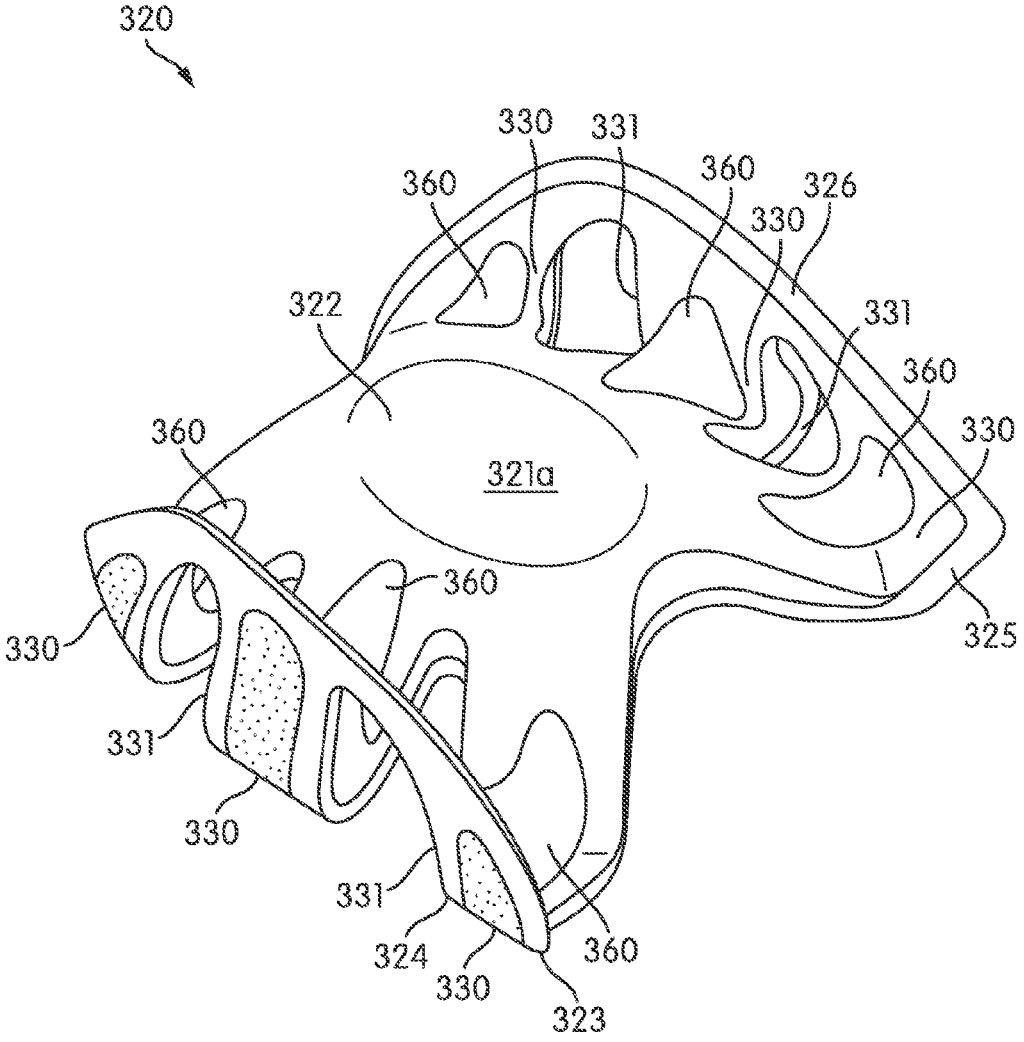
FIG. 8 is a top perspective view of a flexure element in accordance with certain aspects of this disclosure.

According to even other aspects and as illustrated in FIG. 8, flexure element 320 need not include a landing at its front end (see landing 328 in FIG. 2A) or even a platform at its rear end (see platform 334 in FIG. 2A). In such case, flexure element 320 would not be secured at its front end to the remainder of sole structure 200, nor would it be secured at its rear end with a pillar to upper support element 310.

Alternative attachment means may be used to attach flexure element 320 to the remainder of footwear 10. For example, pillar 370 may be secured to either flexure element 320 or upper support element 310, but not both. Relative compressive displacement between flexure element 320 and upper support element 310 could result in pillar 370 coming under load after a predetermined amount of relative displacement between upper support element 310 and flexure element 320. As another example embodiment, flanges 324, 326 may be clipped onto (or otherwise attached to) the lateral and medial sides of upper support element 310 such that relative vertical displacement between flanges 324, 326 and upper support element 310 is allowed during vertical compressive loading. In a "no-load" configuration, complementary clip elements would keep the flexure element 320 attached to upper support element 310. For example, flanges 324, 326 may be slidably coupled to upper support element 310 with a pin-in-groove (or other sliding element movable along a track) mechanism. As even another option, upper support element 310 may be provided with downwardly open channels along its lateral and medial sides, with the channels configured to slidingly receive flanges 324, 326 or portions thereof. Various attachment means may be used in combination.

Flexure element 320 may be formed of a relatively lightweight, relatively stiff material. For example, flexure element 320 may be formed of polymeric materials, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. One particular material for use in flexure element 320 may be a nylon/rubber blend, such as a nylon-6/rubber blend. As non-limiting examples, nylon/rubber blends may include nylon/EPDM (ethylene propylene diene monomer) rubber, nylon/EPM (ethylene propylene monomer) rubber, nylon/polypropylene, nylon/polyethylene (LDPE), nylon/poly(butadiene), etc. Optionally, the material of flexure element 320 may also include fillers or other components to tailor its hardness, wear, durability, abrasion-resistance, compressibility, stiffness and/or strength properties. Thus, for example, flexure element 320 may include reinforcing fibers, such as carbon fibers, glass fibers, graphite fibers, aramid fibers, basalt fibers, etc. Even further, flexure element 320 may include one or more metal elements or subcomponents. Such metal subcomponents may be particularly suitable in high stress, high strain areas of the flexure element 320. Other materials, as would be apparent to persons of ordinary skill in the art as suitable for the flexure element 320, given the benefit of this disclosure, may be provided.

Figure 9A:
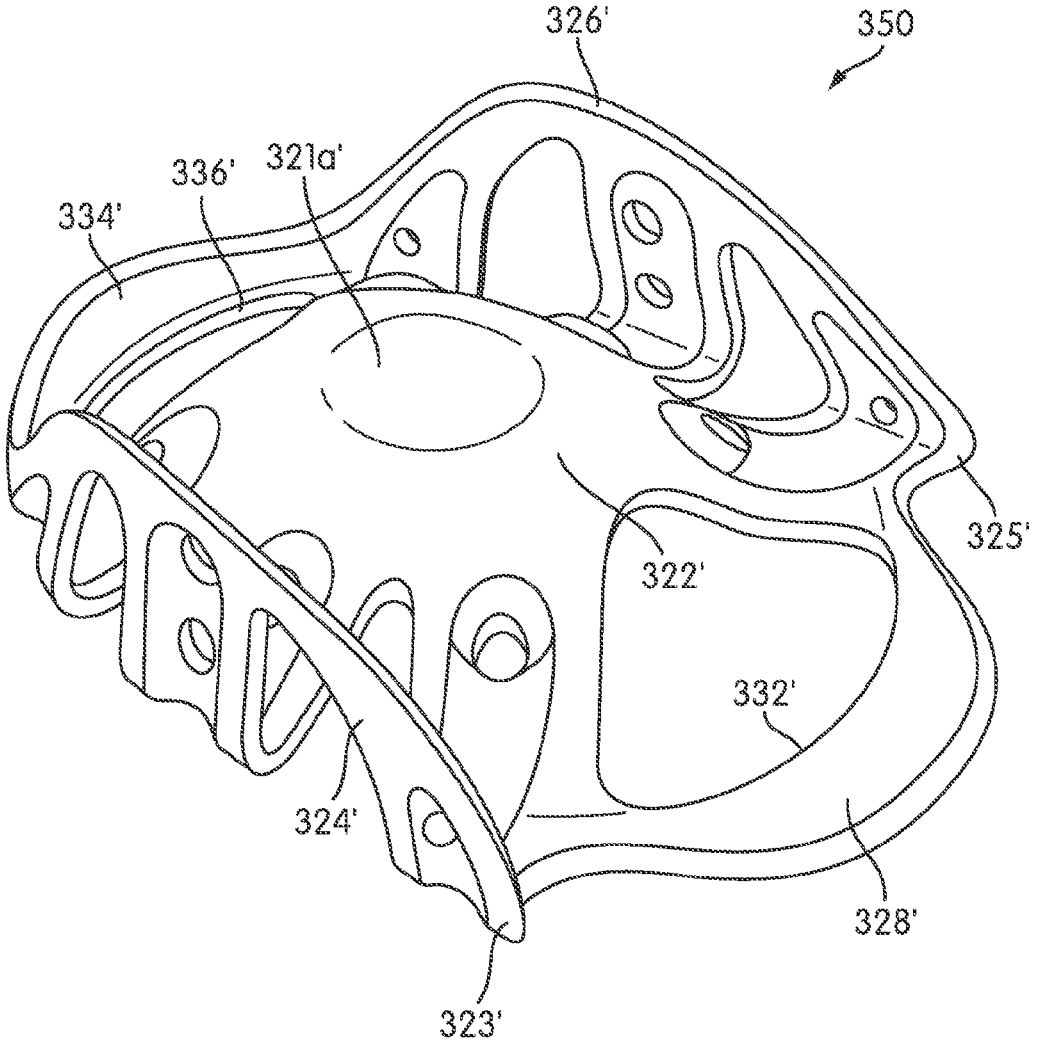
FIG. 9A is a top perspective view of a central layer of a flexure element in accordance with even other aspects of this disclosure.

Further, flexure element 320 may be formed of multiple materials. According to certain aspects, flexure element 320 may be formed of more than one layer, wherein the different layers may be formed of different materials. Referring to FIGS. 2A-2B and also to FIG. 4F, flexure element 320 may be formed of three layers, a central layer 350, a top layer 352 and a bottom layer 354. An example embodiment of a central layer 350 is shown in FIG. 9A. In this embodiment, central layer 350 includes a central portion 322', a lateral flange 324' and a medial flange 326'. Central portion 322' extends from a lateral lower edge 323' to a centrally located downwardly concavely-curved portion or region 321*a*' and then to a medial lower edge 325'. Central portion 322' is joined to flanges 324', 326' at edges 323', 325', respectively. A relatively flat portion or landing 328' and a front cutout 332' is provided. At the rear edge, a platform 334' and a rear cutout 336' is provided. Central layer 350 may be formed by any suitable method, including injection molding, compression molding, etc.

Figure 9B:
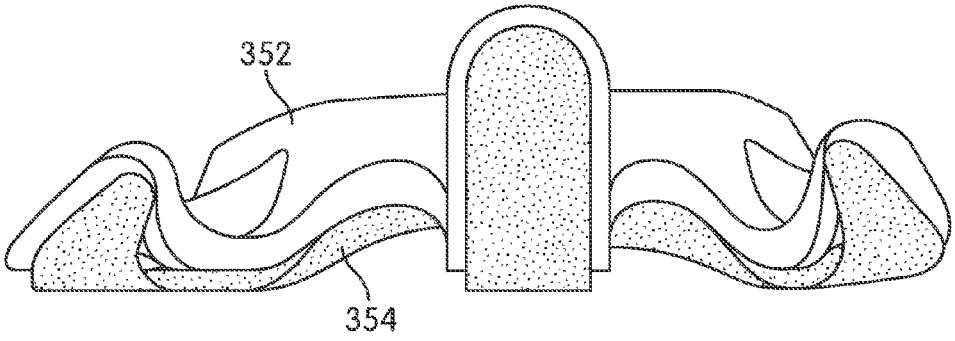
FIG. 9B is a side perspective view of the top and bottom layers of a flexure element for use with the central layer of FIG. 9A.
Figure 9C:
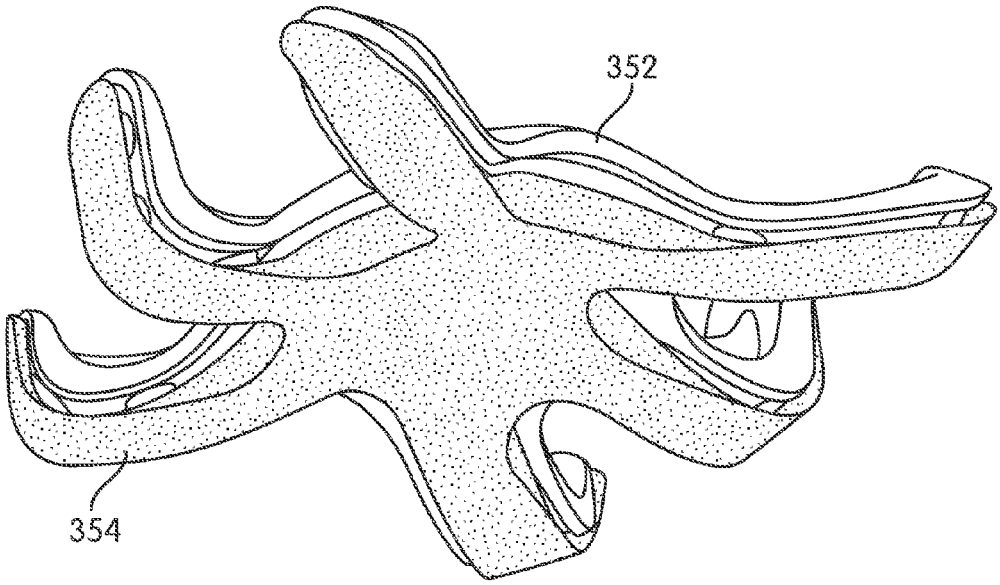
FIG. 9C is a perspective view taken from the bottom of the top and bottom layers of a flexure element for use with the central layer of FIG. 9A.

An example embodiment of the top layer 352 and the bottom layer 354 is shown in FIGS. 9B and 9C. In these figures, top layer 352 and bottom layer 354 are shown as a single component which would be co-molded on opposite sides of central layer 350. Top layer 352 and bottom layer 354 may be formed of a different material than central layer 350 and of the same or different material from each other. According to some aspects, the material of central layer 350 may be harder and stiffer than the material(s) of top layer 352 and/or bottom layer 354. In general, layers 350, 352, 354 may be formed of any conventional midsole and/or outsole materials, including natural or synthetic rubber or a combination thereof. The material may be solid, foamed, filled, etc. or a combination thereof. By way of non-limiting examples, suitable polymeric materials for layers 352, 354 may include materials as listed above for flexure element 320. According to certain embodiments, one or both of top layer 352 and bottom layer 354 may be co-molded or over-molded with central layer 350. Alternatively, one or both of top layer 352 and bottom layer 354 may be molded separately from central layer 350 and subsequently attached thereto. In some embodiments, flexure element 320 may be formed of a plurality of layers, wherein at least a portion of at least two of the plurality of layers are visible from an exterior of the article of footwear.

Optionally, flexure element 320 may be formed of a single material as a single layer. In general, flexure element 320 may be formed of any number of layers and of any number of materials. Further, flexure element 320 and/or layers 350, 352, 354 need not be integrally formed. For example, portions of flexure element 320 and/or portions of layers 350, 352, 354 may be separately formed and subsequently joined to each other to form a unitary component.

Even further, along the lower edges 323, 325 of flexure element 320, a ground-contacting layer may be provided. Ground-contacting layer may include any suitable material as known to persons of skill in the art. Further, ground-contacting layer may be applied or secured to flexure element 320 in any conventionally known fashion. Alternatively, along the lower edges 323, 325 a material suitable for sliding on a top surface of an outsole portion may be applied to flexure element 320.

Similar to flexure element 320, upper support element 310 may be formed of a relatively lightweight, relatively stiff material. For example, upper support element 310 may be formed of conventional midsole and/or outsole materials, such as natural or synthetic rubber or a combination thereof. The material may be solid, foamed, filled, etc. or a combination thereof. One particular rubber for use in upper support element 310 may be a solid rubber having a typical Shore A hardness of between 74-80. The rubber may be a natural rubber, a synthetic rubber or a combination thereof. As an example, a particular composite rubber mixture may include approximately 75% natural rubber and 25% synthetic rubber such as a styrene-butadiene rubber. By way of non-limiting examples, other suitable polymeric materials for upper support element 310 include plastics, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, the material of upper support element 310 may also include fillers or other components to tailor its hardness, wear, durability, coefficient of friction, abrasion-resistance, compressibility, stiffness and/or strength properties. Thus, for example, upper support element 310 may include reinforcing fibers, such as carbon fibers, glass fibers, graphite fibers, aramid fibers, basalt fibers, etc.

Gussets 360 may be integrally formed with flexure element 320 of the same material as flexure element 320. Optionally, gussets 360 may be formed separately from the central portion 322 and the flanges 324, 326 of flexure element 320. For example, gussets 360 may be co-molded with flexure element 320 (or any of its layers 350, 352, 354) or adhesively secured to the remainder of flexure element 320. Even further, gussets 360 may include a metal (or other relatively strong, flexible material) as a skeleton, around which the polymeric materials of flexure element 320 are co-molded or otherwise formed and secured.

Figure 10:
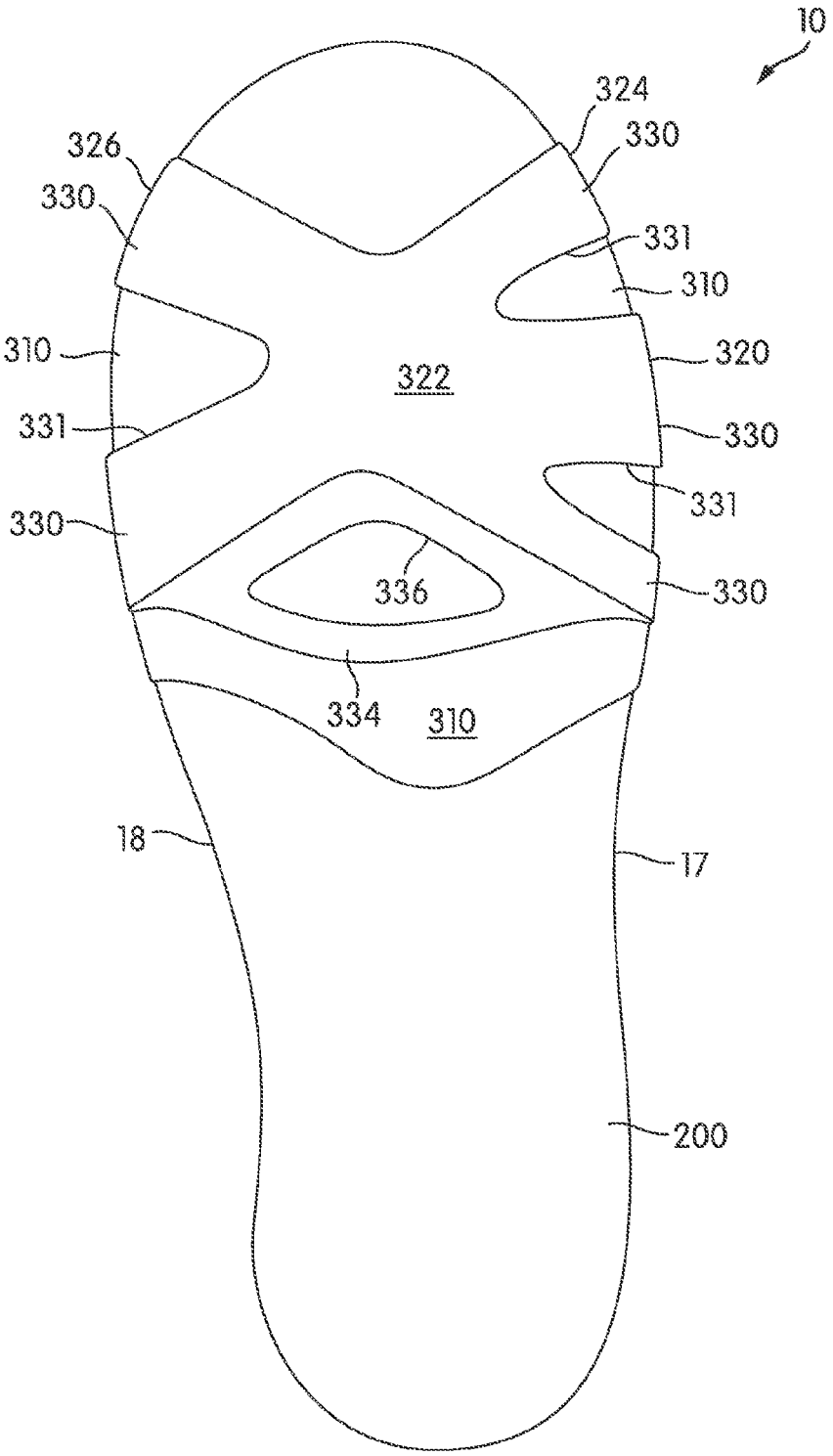
FIG. 10 is a schematic bottom view of an article of footwear in accordance with aspects of this disclosure.

According to even other aspects of this disclosure and as shown in FIG. 10, a support assembly structure 300 may be provided in the forefoot region 11 of the article of footwear 10. In this particular embodiment, flexure element 320 includes a rear platform 334, but not a front landing 328. Further, on the medial side, only one cutout 331 and two legs 330 are provided, whereas on the lateral side, two cutouts 331 and three legs 330 are provided.

In such an embodiment, it is expected that the overall height of the support assembly structure 300 provided in the forefoot region 11 would typically be less than that of a support assembly structure 300 provided in the heel region 13. By way of non-limiting examples, the height of the central portion 322 (as measured from the ground contacting surface of the lower edges 323, 325 to the surface that contacts plate 312 of upper support element 310) of a support assembly structure 300 provided in the heel region 13 may range from approximately 10.0 mm to approximately 30.0 mm, from approximately 15.0 mm to approximately 30.0 mm or from approximately 20.0 mm to approximately 30.0 mm. For comparison purposes, the height of the central portion 322 of a support assembly structure 300 provided in the forefoot region 13 may range from approximately 5.0 mm to approximately 15.0 mm, from approximately 8.0 mm to approximately 15.0 mm or from approximately 10.0 mm to approximately 15.0 mm.

Thus, from the above disclosure it can be seen that the decoupled (or partially decoupled) vertical and lateral stiffness characteristics of sole structure 200 due to support assembly structure 300 may provide improved vertical impact protection, while still achieving the desired degree of stability (or, alternatively, flexibility) for a wearer of the article of footwear.

The performance characteristics of the support assembly structure are primarily dependent upon factors that include the dimensional configurations of flexure element 320 and the properties of the material selected for the flexure element. By designing flexure element 320 to have specific dimensions and material properties, cushioning and stability of the footwear may be generally tuned to meet the specific demands of the activity for which the footwear is intended to be used. For walking shoes, for example, the dimensional and material properties of flexure element 320 may be selected to provide a medium degree of vertical impact force attenuation with a high degree of lateral stability. For running shoes, the impact-attenuating properties of the central portion 322 of the flexure element 320 may be enhanced, while still maintaining a relatively high degree of lateral stability. As another example, the dimensional and material configuration of the flanges 324, 326 and/or the legs 330 of the flexure element 320 may also be selected to provide an even greater degree of lateral stability in basketball shoes.

In general, the dimensional and material properties of central portion 322 of flexure element 320 will be selected to accommodate expected vertical impact loads and to provide a generally preferred degree of impact-attenuation for a particular activity, while the dimensional and material properties of flanges 324, 326 of flexure element 320 will be selected to a provide the preferred degree of lateral stability and/or lateral motion control. Thus, the disclosed support assembly system allows the sole structure 200 to be tailored to the specific application.

Even further, additional components or elements may augment support assembly structure 300. For example, foamed or solid elements of elastically compressible material (not shown) may be placed within the support assembly structure 300. Other augmenting elements may include air bags and/or filled/or unfilled pillows of any of various shapes and firmness. Even other augmenting elements may include spring elements and/or stiffeners. Such augmenting elements may serve to attenuate impact loads, to stabilize portions of the support assembly structure 300, to store and return energy and/or to prevent debris from fouling the support assembly structure 300. For example, foam elements may encapsulate or partially encapsulate one or more of the individual components of the support assembly structure 300. Alternatively, augmenting elements may extend between one or more of the individual components of the support assembly structure 300 and/or be integrally joined to one or more of the individual components of the support assembly structure 300.

While the invention has been described with respect to specific examples including presently preferred modes of carrying out the invention, those skilled in the art, given the benefit of this disclosure, will appreciate that there are numerous variations and permutations of the above described structures, systems and techniques that fall within the spirit and scope of the invention as set forth above. Thus, for example, a wide variety of materials, having various properties, i.e., flexibility, hardness, durability, etc., may be used without departing from the invention. Finally, all examples, whether preceded by "for example," "such as," "including," or other itemizing terms, or followed by "etc.," are meant to be non-limiting examples, unless otherwise stated or obvious from the context of the specification.

We claim:

1. A sole structure of an article of footwear, the sole structure comprising:

a flexure element defining a lowermost surface of the article of footwear and having:

(a) a central portion located between a first ground-contacting region and a second ground-contacting region, the central portion having a downwardly concavely-curved plate region, and (b) first and second flanges extending upward from the first and second ground-contacting regions, respectively; and an upper support element positioned above the central portion, between the first and second flanges of the flexure element, and below upper edges of the first and second flanges of the flexure element, and below upper edges of the first and second flanges of the flexure element, wherein the upper support element is configured to move vertically relative to the first and second flanges when a vertical compressive load is first applied to the upper support element, and wherein the central portion, the first ground-contacting region, the second ground-contacting region, and the first and second flanges are integrally formed of a single material as a single layer.

2. The sole structure of claim 1, wherein the upper support element is configured to compress the downwardly concavely-curved plate region of the flexure element when a vertical compressive load is applied to the upper support element.

3. The sole structure of claim 1, wherein the first and second flanges are configured to slidably interface with the upper support element when a vertical compressive load is first applied to the upper support element.

4. The sole structure of claim 1, wherein at least one of the first and second ground-contacting regions moves transversely relative to the downwardly concavely-curved plate region when a vertical compressive load is first applied to the downwardly concavely-curved plate region of the flexure element.

5. The sole structure of claim 1, wherein the downwardly concavely-curved plate region is dome-shaped.

6. The sole structure of claim 1, wherein the first ground-contacting region extends along a lateral side of the sole structure and the second ground-contacting region extends along a medial side of the sole structure.

7. The sole structure of claim 1, wherein a plurality of legs extends across at least one of the first and second ground-contacting regions.

8. The sole structure of claim 1, wherein at least one of the first and second flanges includes at least one cutout that is transversely visible from an exterior of the article of footwear.

9. The sole structure of claim 1, wherein the flexure element includes an upwardly concavely-curved region between the downwardly concavely-curved plate region and one of the first and second ground-contacting regions.

10. The sole structure of claim 1, wherein the flexure element includes a first upwardly concavely-curved region between the downwardly concavely-curved plate region and the first ground-contacting region, and wherein the central portion includes a second upwardly concavely-curved region between the downwardly concavely-curved plate region and the second ground-contacting region.

11. The sole structure of claim 10, wherein at least one of the first and second upwardly concavely-curved regions includes at least one cutout that is visible from a bottom exterior of the article of footwear.

12. The sole structure of claim 1, wherein at least one gusset extends between the central portion and one of the first and second flanges.

13. The sole structure of claim 1, further comprising at least one additional layer positioned on the flexure element, wherein at least a portion of at least two of the flexure element and the at least one additional layer are visible from an exterior of the article of footwear.

14. The sole structure of claim 1, wherein the flexure element includes at least one of a front end and a rear end configured for attachment to a remainder of the sole structure.

15. The sole structure of claim 14, wherein the at least one of the front end and the rear end configured for attachment to a remainder of the sole structure includes a cutout.

16. The sole structure of claim 1, wherein the flexure element is positioned in a heel region of the sole structure.

17. The sole structure of claim 1, wherein the flexure element is positioned in a forefoot region of the sole structure.

18. A support assembly structure for an article of footwear, the support assembly structure comprising:

a flexure element defining a lowermost surface of the article of footwear, having a lateral side and a medial side, and extending from a first ground-contacting region extending along the lateral side to a second ground-contacting region extending along the medial side, the flexure element having a central portion extending from the lateral to the medial side, the central portion having a doubly-recurved cross-section, and the flexure element having first and second flanges extending upward from the first and second ground-contacting regions, respectively, the central portion having a central area that is downwardly concave and edges that curve upwardly to define the first and second ground-contacting regions and that continue upwardly into the first and second flanges, wherein the central portion, the first ground-contacting region, the second ground-contacting region, and the first and second flanges are integrally formed of a single material as a single layer.

19. The support assembly structure of claim 18, wherein at least one of the first and second flanges has a plurality of legs.

20. The support assembly structure of claim 19, wherein the plurality of legs extends across at least one of the first and second ground-contacting regions.

21. The support assembly structure of claim 18, wherein the flexure element has at least one gusset extending from the central portion to one of the first and second flanges.

22. The support assembly structure of claim 18, further comprising an upper support element positioned above the central portion and between the first and second flanges of the flexure element.

23. An article of footwear comprising:

an upper and a sole structure, the sole structure including a support assembly structure having a flexure element and an upper support element;

the flexure element defining a lowermost surface of the article of footwear and having:

a central portion located between a first ground-contacting region and a second ground-contacting region, the central portion having a downwardly concavely-curved plate region, and first and second flanges extending upward from the first and second ground-contacting regions, respectively; and the upper support element positioned above the central portion, between the first and second flanges of the flexure element, and below upper edges of the first and second flanges of the flexure element, wherein the upper support element is configured to move vertically relative to the first and second flanges when a vertical compressive load is first applied to the upper support element, and wherein the central portion, the first ground-contacting region, the second ground-contacting region, and the first and second flanges are integrally formed of a single material as a single layer.

24. The article of footwear of claim 23, wherein the upper support element is configured to compress the downwardly concavely-curved plate region of the flexure element when a vertical compressive load is applied to the upper support element.

25. The article of footwear of claim 23, wherein the first and second flanges are configured to slidably interface with the upper support element when a vertical compressive load is first applied to the upper support element.

26. The article of footwear of claim 23, wherein at least one of the first and second ground-contacting regions moves transversely relative to the downwardly concavely-curved plate region when a vertical compressive load is first applied to the downwardly concavely-curved plate region of the flexure element.

27. The article of footwear of claim 23, wherein the first ground-contacting region extends along a lateral side of the sole structure and the second ground-contacting region extends along a medial side of the sole structure.

28. The article of footwear of claim 23, wherein a plurality of legs extends across at least one of the first and second ground-contacting regions.

29. The article of footwear of claim 23, wherein at least one of the first and second flanges includes at least one cutout that is transversely visible from an exterior of the article of footwear.

30. The article of footwear of claim 23, wherein the flexure element includes an upwardly concavely-curved region between the downwardly concavely-curved plate region and one of the first and second ground-contacting regions.

31. The article of footwear of claim 23, wherein the flexure element includes a first upwardly concavely-curved region between the downwardly concavely-curved plate region and the first ground-contacting region, and wherein the central portion includes a second upwardly concavely-curved region between the downwardly concavely-curved plate region and the second ground-contacting region.

32. The article of footwear of claim 23, wherein at least one gusset extends between the central portion and one of the first and second flanges.

33. The article of footwear of claim 23, further comprising at least one additional layer positioned on the flexure element, wherein at least a portion of at least two of the flexure element and the at least one additional layer are visible from an exterior of the article of footwear.

34. The article of footwear of claim 23, wherein the flexure element includes at least one of a front end and a rear end configured for attachment to a remainder of the sole structure.

35. The article of footwear of claim 34, wherein the at least one of the front end and the rear end configured for attachment to a remainder of the sole structure includes a cutout.

36. The article of footwear of claim 23, wherein the support assembly structure is positioned in a heel region of the sole structure.

* * * * *